US008596203B2

(12) United States Patent
Forbes et al.

(10) Patent No.: US 8,596,203 B2
(45) Date of Patent: Dec. 3, 2013

(54) RAILROAD CAR AND DOOR MECHANISM THEREFOR

(75) Inventors: James W. Forbes, Campbellville (CA); Tomasz Bis, Ancaster (CA)

(73) Assignee: National Steel Car Limited, Hamilton, Ontario ( * ) Notice: Subject to any disclaimer, the term of this patent is extended or adjusted under 35 U.S.C. 154(b) by 169 days.

(21) Appl. No.: 13/105,664

(22) Filed: May 11, 2011

(65) Prior Publication Data

US 2012/0285346 A1 Nov. 15, 2012

(51) Int. Cl.
*B61D 3/00* (2006.01)

(52) U.S. Cl.
USPC ..... 105/248; 105/250

(58) Field of Classification Search
USPC ..... 105/280, 282.1–282.3, 247, 248, 253, 105/286, 288, 305
See application file for complete search history.

(56) References Cited

U.S. PATENT DOCUMENTS

| | | | |
|---|---|---|---|
| 682,902 | A | 11/1901 | Muller et al. |
| 688,809 | A | 12/1901 | Hansen |
| 693,132 | A | 2/1902 | Heiden |
| 1,092,659 | A | 4/1914 | Mettler |
| 1,161,240 | A | 11/1915 | Neikirk |
| 1,297,356 | A | 3/1919 | Junghanns |
| 1,421,439 | A | 7/1922 | Finckh |
| 1,436,310 | A | 11/1922 | Gilpin |
| 1,706,353 | A | 3/1929 | Dorey |
| 1,848,901 | A | 3/1932 | Neikirk |
| 1,981,714 | A | 11/1934 | Yost |
| 2,741,193 | A | 4/1956 | Zimmer |
| 3,137,247 | A | 6/1964 | Hamilton et al. |
| 3,161,146 | A | 12/1964 | Lutts et al. |
| 3,187,684 | A | 6/1965 | Ortner |
| 3,315,616 | A | 4/1967 | Beaver et al. |
| 3,316,857 | A | 5/1967 | Floehr |
| 3,385,231 | A | 5/1968 | Dorey |
| 3,408,956 | A | 11/1968 | Rebenok et al. |

(Continued)

FOREIGN PATENT DOCUMENTS

| | | |
|---|---|---|
| CA | 1082524 | 7/1980 |
| CN | 101486347 A | 7/2009 |

(Continued)

*Primary Examiner* — Jason C Smith
(74) *Attorney, Agent, or Firm* — Hahn Loeser & Parks, LLP

(57) ABSTRACT

A hopper car discharge outflow is controlled by closure members, at least one of which is movable. The doors are hingeless, being mounted on four bar linkages, such that the distal edge of the doors sweeps predominantly horizontally while the proximal edge of the door moves predominantly upwardly. The doors move through noncircular arcs, such that the size of the vertically projected door opening is abnormally large compared to the clearance heights of the door. The doors are driven by a transverse drive linkage that is driven by a transversely mounted actuator. The actuator is mounted in an accommodation in the lee of slope sheets between adjacent hoppers in a mid-span portion of the car. Drive from the actuator is carried to a pair of symmetrically mounted doors through drive train linkages. The drive train includes longitudinally extending torque tubes that transmit drive to both fore and aft ends of the door assemblies. The car also has a lost motion secondary lock system, an alternate manual drive door opening and closing drive train, and abnormally high side sills and a center sill that passes clear through the discharge sections at a height clearly lower than the upper margin of the discharge sections.

31 Claims, 27 Drawing Sheets

(56) References Cited

U.S. PATENT DOCUMENTS

| | | | | | |
|---|---|---|---|---|---|
| 3,447,485 | A | | 6/1969 | Dorey | |
| 3,455,253 | A | | 7/1969 | Floehr | |
| 3,515,075 | A | | 6/1970 | Damy | |
| 3,596,608 | A | | 8/1971 | Aquino et al. | |
| 3,608,500 | A | | 9/1971 | Floehr | |
| 3,633,515 | A | | 1/1972 | Shaver et al. | |
| 3,717,109 | A | * | 2/1973 | Miller | 105/284 |
| 3,772,996 | A | | 11/1973 | Schuller | |
| 3,800,711 | A | | 4/1974 | Tuttle | |
| 3,805,708 | A | | 4/1974 | Schuller et al. | |
| 3,815,514 | A | | 6/1974 | Heap | |
| 3,818,842 | A | | 6/1974 | Heap | |
| 3,863,986 | A | | 2/1975 | Mentessi | |
| 3,878,794 | A | | 4/1975 | Adler | |
| 3,931,768 | A | | 1/1976 | Price et al. | |
| 3,949,681 | A | * | 4/1976 | Miller | 105/284 |
| 3,994,238 | A | | 11/1976 | Adler | |
| 4,051,960 | A | | 10/1977 | Raksanyi | |
| 4,106,813 | A | | 8/1978 | Goodbary | |
| 4,120,409 | A | | 10/1978 | vander Werff | |
| 4,138,948 | A | | 2/1979 | Korolis | |
| 4,222,334 | A | * | 9/1980 | Peterson | 105/250 |
| 4,232,989 | A | | 11/1980 | Miller | |
| 4,250,814 | A | | 2/1981 | Stark et al. | |
| 4,480,954 | A | * | 11/1984 | Manstrom | 414/383 |
| 4,542,701 | A | | 9/1985 | Fischer et al. | |
| 4,601,244 | A | * | 7/1986 | Fischer | 105/240 |
| 4,688,488 | A | | 8/1987 | Adams et al. | |
| 4,740,130 | A | | 4/1988 | Prins | |
| 4,741,274 | A | | 5/1988 | Ferris et al. | |
| 4,766,820 | A | | 8/1988 | Ritter et al. | |
| 4,829,908 | A | | 5/1989 | Hallam | |
| 4,843,974 | A | | 7/1989 | Ritter et al. | |
| 4,884,511 | A | | 12/1989 | Hallam et al. | |
| 5,086,709 | A | | 2/1992 | Fischer et al. | |
| 5,144,895 | A | | 9/1992 | Murray | |
| 5,163,372 | A | | 11/1992 | Galvan et al. | |
| 5,249,531 | A | | 10/1993 | Taylor | |
| 5,261,333 | A | | 11/1993 | Miller | |
| 5,823,118 | A | * | 10/1998 | Manstrom | 105/284 |
| 6,019,049 | A | | 2/2000 | Gaydos et al. | |
| 6,279,487 | B1 | | 8/2001 | Gaydos et al. | |
| 6,405,658 | B1 | | 6/2002 | Taylor | |
| 6,604,469 | B1 | | 8/2003 | Galvan et al. | |
| 6,955,126 | B2 | * | 10/2005 | Taylor | 105/250 |
| 6,955,127 | B2 | | 10/2005 | Taylor | |
| 7,051,661 | B2 | | 5/2006 | Herzog et al. | |
| 7,080,598 | B2 | | 7/2006 | Creighton et al. | |
| 7,080,599 | B2 | | 7/2006 | Taylor | |
| 2006/0254456 | A1 | * | 11/2006 | Taylor | 105/284 |
| 2006/0272541 | A1 | | 12/2006 | Taylor | |
| 2012/0285346 | A1 | * | 11/2012 | Forbes et al. | 105/248 |

FOREIGN PATENT DOCUMENTS

| | | | |
|---|---|---|---|
| EP | 0543279 | B1 | 5/1995 |
| EP | 1798103 | A2 | 6/2007 |
| GB | 1318571 | | 5/1973 |
| GB | 2013598 | A | 8/1979 |

* cited by examiner

RAILROAD CAR AND DOOR MECHANISM THEREFOR

FIELD OF THE INVENTION

This invention relates to the field of railroad freight cars, and, in particular to rail road freight cars such as may employ bottom unloading gates or doors.

BACKGROUND

There are many kinds of rail road cars for carrying particulate material, be it sand or gravel aggregate, plastic pellets, grains, ores, potash, coal or other granular materials. Many of those cars have an upper opening, or accessway of some kind, by which the particulate is loaded, and a lower opening, or accessway, or gate, or door by which the particulate material exits the car under the influence of gravity. While the inlet opening need not necessarily have a movable gate, the outlet opening requires a governor of some kind that is movable between a closed position for retaining the lading while the lading is being transported, and an open position for releasing the lading at the destination. The terminology "flow through" or "flow through rail road car" or "center flow" car, or the like, may sometimes be used for cars of this nature where lading is introduced at the top, and flows out at the bottom.

Discharge doors for coal gondola cars or other bottom dumping cars may tend to have certain desirable properties. First, to the extent possible it is usually desirable for the door opening to be large so that unloading may tend to be relatively fast, and for the sides of any unloading chute to be relatively steep so that the particulate will tend not to hang up on the slope. Further, to the extent that the door can be large and the slope sheets steep, the interior of the car may tend to have a greater lading volume for a given car length. Further still, any increase in lading achieved will tend to be at a relatively low height relative to Top of Rail (TOR) and so may tend to aid in maintaining a low center of gravity. A low center of gravity tends to yield a better riding car that is less prone to derailment, and perhaps less prone to cause as much wear or damage to tracks. Some cars, such as ballast cars, or cars designed for releasing lading between the rails, may tend to benefit from having discharge doors that are oriented longitudinally, such that the discharge lip of the door runs substantially parallel to the longitudinal centerline of the car, and, in opening, the motion of the door may tend to be predominantly in a direction transverse to the centerline of the car.

SUMMARY OF THE INVENTION

In an aspect of the invention there is a railroad car having a body for carrying lading in the form of particulate matter. The car body is carried upon railroad car trucks for motion along railroad tracks in a longitudinal direction. The car body has at least one discharge through which the lading may be disgorged under the influence of gravity. The discharge is governed by a door mechanism. The door mechanism includes a door panel movable from a first position to a second position. The first position defines a closed position of the discharge in which the door panel obstructs exit of the lading. The second position defines an open position of the discharge. The door panel is movably connected to the car body by at least a first linkage member and a second linkage member, the car body, the linkage members and the door panel defining a four bar linkage. The door panel extends length-wise relative to the car body, and the door mechanism is a longitudinal door operating mechanism operable to move the door panel in a cross-wise direction relative to the railroad car body.

In another feature, the car includes a cross-wise acting drive mechanism connected to move the door panel between the open position and the closed position. In a further feature, the railroad car has a longitudinal centerline and the drive mechanism includes members acting transversely on either side of the longitudinal centerline. In still another feature the drive mechanism includes at least one driving linkage operable to move left and right hand doors simultaneously in opposite directions between the open position and the closed position. In yet another feature the first linkage member is shorter than the second linkage member, and the first linkage member is mounted to the car body further laterally outboard than is the second linkage member. In still yet another feature, the railroad car has a coupler mounted to at least one end of the railroad car. The coupler has a coupler centerline height. The first linkage member has a first pivot connection at which the first linkage member has a first end pivotally mounted to the railroad car body.

In another feature, the door panel has a proximal portion and a distal portion, the linkage members include first and second linkages, and any one of:

(a) the door panel moves through a non-circular arc during motion from the first position to the second position;

(b) the first linkage is connected to the door panel at a connection closer to the proximal portion than to the distal portion, the second linkage is connected to the door panel closer to the distal portion than is the first linkage, and the first and second linkages travel through arcs of travel of different angular magnitudes when the door panel moves between the first position and the second position;

(c) the first linkage is connected to the door panel at a connection closer to the proximal portion than to the distal portion, the second linkage is connected to the door panel closer to the distal portion than is the first linkage, the first linkage is connected to the body of the railroad car at a first pivotal connection, and the proximal portion of the door panel moves from a position lower than the first pivotal connection to a position higher than the first pivotal connection during motion of the door panel from the closed position to the open position;

(d) the first linkage is connected to the door panel at a connection closer to the proximal portion than to the distal portion, the second linkage is connected to the door panel closer to the distal portion than is the first linkage, and the proximal portion of the door panel has an overall dz/dy when the door panel moves between the first and second positions that is greater than one;

(e) the first linkage is connected to the door panel at a connection closer to the proximal portion than to the distal portion, the second linkage is connected to the door panel closer to the distal portion than is the first linkage, and the distal portion of the door panel has an overall dz/dy when the door panel moves between the first position and the second position that is less than one;

(f) the first linkage is connected to the door panel at a connection closer to the proximal portion than to the distal portion, the second linkage is connected to the door panel closer to the distal portion than is the first linkage, and the proximal portion of the door panel has an overall $(dz/dy)_1$ when the door panel moves between the first and second positions that is greater than one, and the distal portion of the door panel has an overall $(dz/dy)_2$ when the door panel moves between the first position and the second position; and $(dz/dy)_1$ is greater than $(dz/dy)_2$.

In still yet another feature, the linkage members include a first linkage, the first linkage is mounted to the railroad car at a first pivot fulcrum located a first distance above Top of Rail; the first door panel has a width and a length, the width being oriented cross-wise relative to the car body generally, and the length being greater than the first distance.

In another aspect of the invention, there is a railroad hopper car having a lading containment car body mounted upon railroad car trucks for rolling motion in a longitudinal direction along railroad car tracks, the hopper car body being compliant with AAR Plate C. The hopper car body has a pair of first and second hopper discharges and respective first and second longitudinal doors operable to move transversely to facilitate egress of lading from the hopper discharges. The hopper discharges have a discharge flow dividing member located therebetween, the discharge flow-dividing member having first and second flanks extending downwardly therefrom toward the first and second discharges respectively. A sheltered accommodation being defined between those flanks. Each of the doors is movable from (a) a first position obstructing egress of lading from one of the respective hopper discharges to (b) a second position less obstructive of discharge of lading from the respective hopper discharges. Each of the longitudinal doors has a proximal region and a distal region. In the first position the proximal region is located more transversely outboard than is the distal region. Each of the proximal regions is connected by first and second linkage members to the car body. The first and second linkages have pivoting connections at either end thereof. In operation, the proximal regions of the first and second doors move upwardly and transversely outboard, the motion being more predominantly upwardly than outboard, the linkages not protruding widthwise beyond AAR Plate C more than 3 inches during motion thereof. During motion of the linkages the distal regions of the doors moving more predominantly transversely outboard than upward. A drive train operable to move the doors is mounted in the sheltered accommodation In another feature, the first and second linkage members are short linkage members; there are also first and second long linkage members mounted to the distal region; and the car body, the short linkage members, the long linkage members and the door panel defining a four bar linkage.

In a further feature, the drive train includes an actuator mounted in the accommodation, the actuator being mounted to work transversely.

In another aspect of the invention, there is a railroad hopper car having a car body mounted on railroad car trucks for rolling motion in a longitudinal direction along railroad tracks. The car body has a hopper, and the bottom portion of the hopper includes a hopper discharge, egress of lading through the hopper discharge being governed by a door assembly. The door assembly is movable between a closed position for obstructing discharge of lading from the hopper, and at least one open position for permitting discharge of lading from the hopper. The door assembly is an hingeless door assembly, the door assembly including a door panel, the door panel being mounted to move on a non-circular path transversely to the longitudinal rolling direction during motion between the closed position and the at least one open position.

In a feature of that aspect of the invention the door panel has a translational component of motion and a rotational component of motion in moving between the closed position and the at least one open position.

In another feature, the discharge has a length when vertically projected, the discharge has a peripheral edge for engagement by the door assembly, the peripheral edge has a clearance distance from Top of Rail when the car is on level tangent track, and the length is greater than three times the clearance distance.

In still another feature, in the closed position of the door assembly the door panel is in a predominantly horizontal orientation, and in the at least one open position the door assembly is in a less predominantly horizontal orientation. In yet another feature, the door assembly has a fully open position, and in the fully open position the door panel is predominantly vertically oriented. In still another feature, the railroad car has a first hopper, a second hopper, and an accommodation defined therebetween whence lading is excluded. Each of the hoppers has one of the door assemblies. Each door panel of each the door assembly is movable to a most fully open position, and, in the respective most fully open position both of the door panels are at least predominantly sheltered from lading by the accommodation.

In still yet another feature, the car has at least one actuator mounted to drive the door assemblies, and the at least one actuator is also sheltered from lading by the accommodation.

In another aspect of the invention there is a railroad hopper car having a car body mounted on railroad car trucks for longitudinal motion along railroad tracks; the car having at least a first hopper and a first door associated therewith, the first door being a longitudinally oriented door, the first door being mounted to control egress of lading from the at least one hopper; and at least one actuator mounted to drive the longitudinally oriented doors, the hopper car having a longitudinally centerline; the actuator being mounted in a position intermediate the trucks and offset transversely from the longitudinal centerline; and the actuator being oriented to act transversely to the centerline.

In a feature of that aspect of the invention, the car includes both a first hopper and a second hopper. A first the actuator is mounted to operate a first door assembly of the first hopper, and a second the actuator is mounted to operate a second door assembly of the second hopper. The first actuator is mounted to one side of the longitudinal centerline, the second actuator being mounted to the other side of the longitudinal centerline.

In another feature the at least one actuator includes a reciprocating piston, and the piston is mounted such that it has a predominant component of motion in the vertical direction. In still another feature the hopper car has a first drive train connecting the at least one actuator to the longitudinally oriented doors. The drive train includes a linkage movable to an over-center position in which to lock the doors closed. In still another feature, the hopper car has a first drive train connectible operatively to connect the at least one actuator to the longitudinally oriented door. The hopper car has a second drive train connectible operatively to connect a manual drive to the longitudinally oriented door. The first and second drive trains are alternately selectable. The manual drive is positioned at one side of the hopper car such that the manual drive is operable by a person standing at trackside.

In another aspect of the invention there is a railroad hopper car having doors movable between an open condition and a closed condition, the hopper car having a door position indicator, the door position indicator including an annunciator member mounted to show that the doors are closed and locked; and, the annunciator is driven by a mechanical motion amplifier activated to present a protruding mechanical member when the doors are not closed and locked.

In another feature of that aspect of the invention the mechanical transmission is movable to an over center condition, and the mechanical motion amplifier is connected to activate the member mounted to show that the doors are closed and locked when the mechanical transmission is in the over-center condition.

In another aspect of the invention there is a railroad hopper car. It has a car body defining an open-topped lading containment receptacle. The car body has first and second end sections mounted over trucks for rolling motion along railroad tracks in a longitudinal direction. The lading containment receptacle including at least a first hopper. The first hopper includes at least a first discharge section, and at least a first door positioned to govern egress of lading from the hopper through the discharge section under the influence of gravity. The car body including a straight through center sill running between the first and second end sections. The car body includes first and second side sills running between the first and second end sections. The first discharge section extends downwardly of the side sills. The first discharge section has laterally extending end walls. The end walls have respective center sill penetrations through which the center sill passes. The center sill has a top cover plate located at a first height relative to top of rail, all of the center sill being located below the first height. The side sills are located at a second height relative to top of rail, all of the side sills being located above the second height. The second height is greater than the first height.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
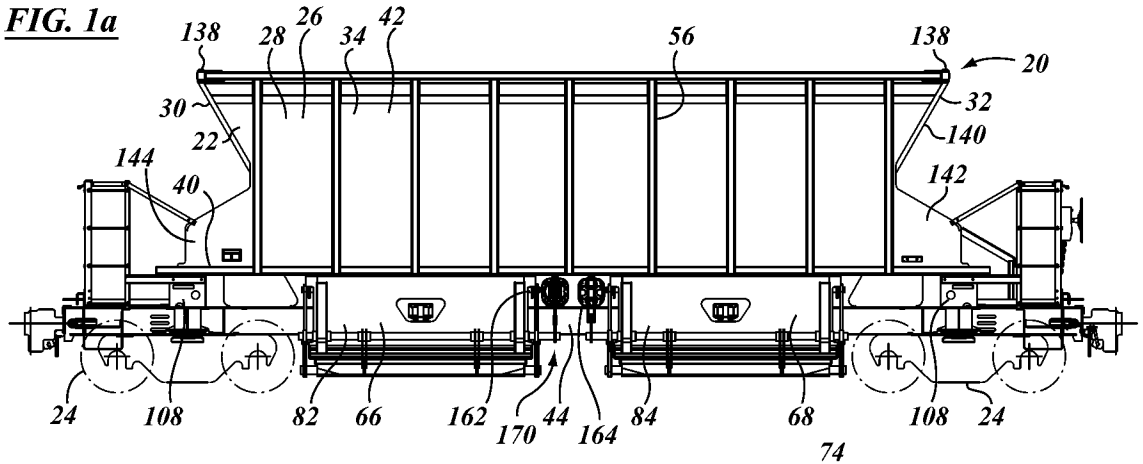
FIG. 1*a* is a general arrangement, side view of an embodiment of a railroad freight car according to an aspect of the invention.
Figure 1B:
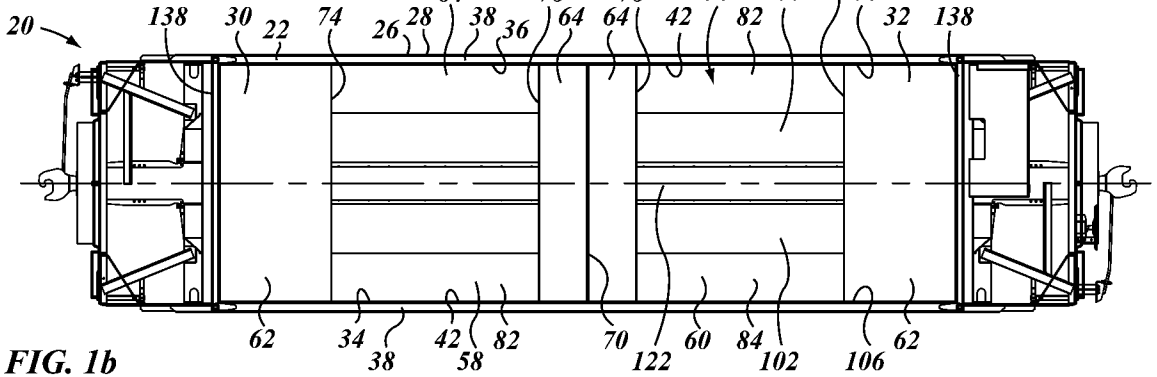
FIG. 1*b* is a top view of the railroad freight car of FIG. 1*a;*
Figure 1C:
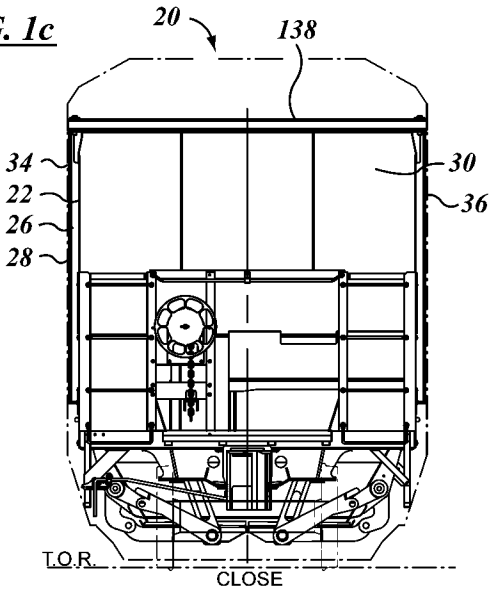
FIG. 1*c* is an end view of the railroad freight car of FIG. 1*a*, without showing the trucks, and with the hopper doors in a closed position.
Figure 1D:
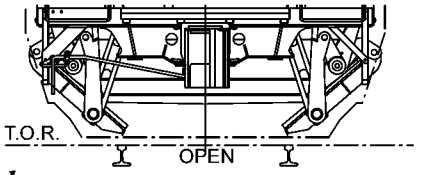
FIG. 1*d* is a partial end view of the railroad freight car of FIG. 1*c*, with hopper doors in a fully open position.
Figure 2C:
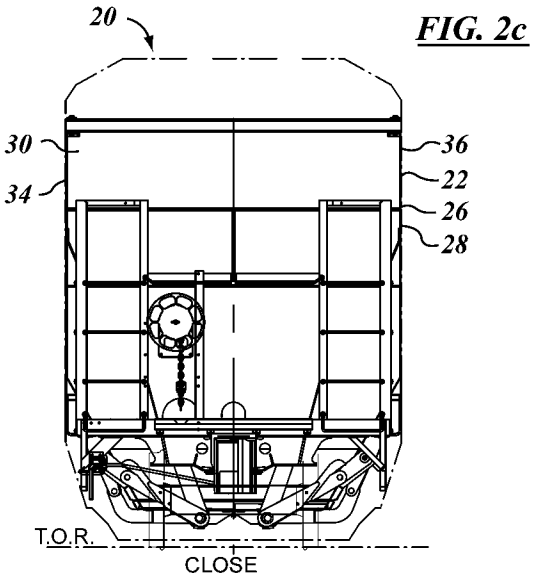
FIG. 2*c* is an end view of the railroad freight car of FIG. 2*a*, without showing the trucks, and with the hopper doors in a closed position.
Figure 2D:
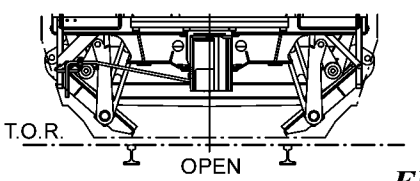
FIG. 2*d* is a partial end view of the railroad freight car of FIG. 2*c*, with hopper doors in a fully open position.
Figure 2A:
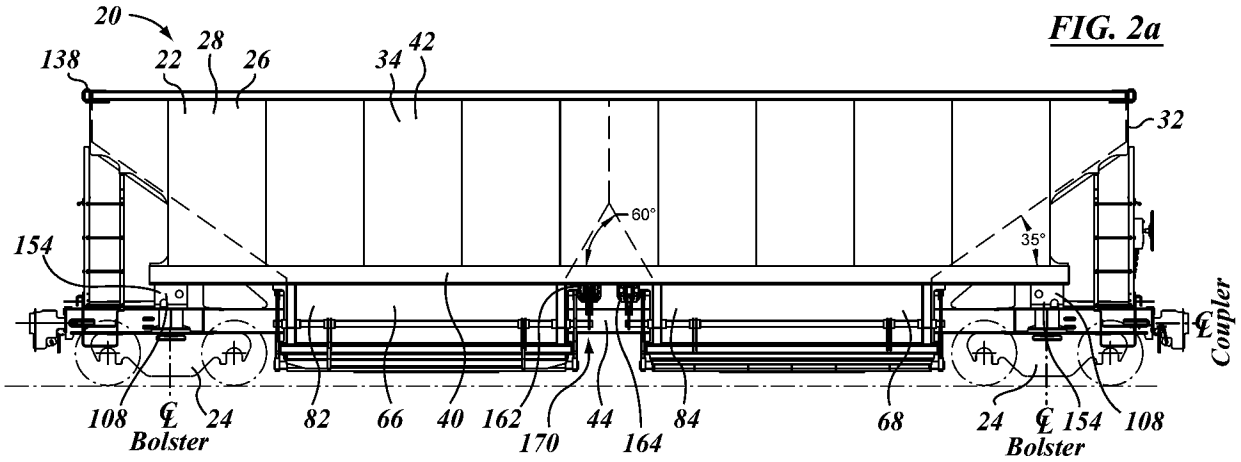
FIG. 2*a* is a general arrangement, side view of another embodiment of a railroad freight car.
Figure 2B:
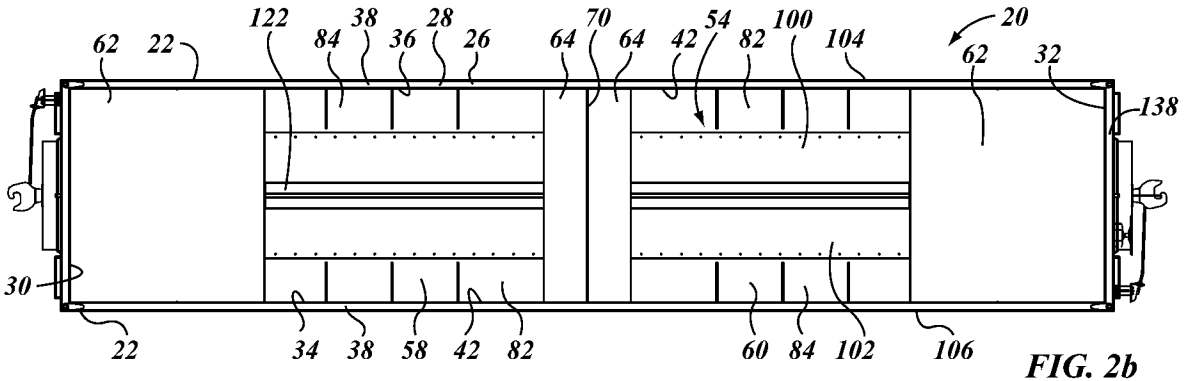
FIG. 2*b* is a top view of the railroad freight car of FIG. 2*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale, and may be taken as being to scale unless otherwise noted. Unless noted otherwise, the structural members of the car may be taken as being fabricated from steel, most typically mild steel of 50 kpsi yield strength. The structure may be of welded construction, most typically, but may alternatively include mechanical fasteners such as Huck™ bolts, rivets, and so on. The structure need not be entirely, or even partially, mild steel, but could include other grades of steel in particular locations, such as the discharge sections, may include consumable wear plates, or plates of greater hardness and wear resistance. In some instances, some or all portions of the primary structure may be made of stainless steel, aluminum, or engineered plastics and composites. Nonetheless, most commonly welded mild steel construction may be assumed as the default condition.

The terminology used in this specification is thought to be consistent with the customary and ordinary meanings of those terms as they would be understood by a person of ordinary skill in the rail road industry in North America. Following from the decision of the Federal Circuit in *Phillips* v. *AWH Corp*., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, in earlier publications by persons not employed by the USPTO or any other Patent Office), demonstrating how the terms are used and understood by persons of ordinary skill in the art, or by way of expert evidence of a person or persons of at least 10 years experience in the rail road industry in North America or in other territories of the former British Empire and Commonwealth.

In terms of general orientation and directional nomenclature, for rail road cars described herein the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, except as otherwise noted a description of one half of the car may generally also be intended to describe the other half as well, allowing for differences between right hand and left hand parts. Similarly, where male and female parts engage, such as a ball and socket connection, a pin and bushing, a pin and slot, and so on, the male and female engaging part relationship may be interchangeable or reversible, the choice being somewhat arbitrary. Therefore unless otherwise noted, or unless the context requires otherwise, interchangeability or reversibility of mating male and female parts may be assumed as a default without requiring further description of the reverse arrangement. In this description, the abbreviation kspi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

Bottom dumping gondola cars, may tend to have either longitudinal doors or transverse doors. The term "longitudinal door" means a door that is oriented such that the doors operate on hinges or axes of rotation that are parallel to the direction of travel (i.e., the "longitudinal direction") of the railroad car generally. An example of a car with longitudinal doors is U.S. Pat. No. 3,633,515 of Shaver, issued Jan. 11, 1972. By contrast, "transverse doors" are doors for which the axes of rotation of the hinges or other pivots tend to be predominantly cross-wise to the direction of travel, most often precisely perpendicular to it on an horizontal axis. An example of a car having transverse doors is shown in US Publication 2008-0066642 of Forbes, published Mar. 20, 2008.

One kind of four bar linkage has a reference, or base, member; a first moving link pivotally connected to the base member; a second link pivotally connected to the base member; and a third link pivotally connected to the distal ends of the first and second links. A drive input to any one of the first, second, or third links relative to the fixed base will then cause motion of all of the links relative to the reference member. In the discussion that follows, the base link is taken to be the underframe or body structure of the railcar generally, that frame of reference being taken as stationary during opening or closing of the various doors. In the examples given below the actual door panel that blocks the outlet opening of the car is the third link, namely the link that is pivotally connected to the ends of the first and second linkages, or pivot arms, rather than being connected to the frame of reference. Most typically some kind of driving mechanism is connected between the first bar, (i.e., the rigid structure of the rail road car defining the datum or frame of reference), and one of the moving bars, be it the first or second pivot arms that define the second and fourth bars of the linkage, or the output member, or third bar, of the four bar linkage. Whatever bar of the linkage is driven, the remaining moving members are then slave linkages whose position is dictated uniquely by the input motion and displacement of the driven member relative to the datum. Most often the driven member is one of the pivot arms.

Four bar linkages are often analyzed as if the linkage lies in a plane. Indeed, to the extent that out-of-plane forces are either non-existent or symmetrical and opposite (and therefore balanced), the forces and motions in question can be considered to be wholly or predominantly in a particular plane. In the case of the examples herein, where the doors are "longitudinal doors" as defined above, the action of the forces, and the displacements, whether translational or rotational, may tend to be considered as occurring in a transverse or cross-wise vertical plane.

In the examples of FIGS. 1*a* to 6*f*, the drive force is carried from a pneumatic piston mounted to act cross-wise to the longitudinal centerline of the car through a drive shaft or ram or cylinder that is mounted to reciprocate in that plane. The reciprocation is pure linear translation with respect to the actuator body, but since that body is itself pivotally mounted to structure, the output action may not be linear but may be on a curve in the transverse plane. The drive shaft transmits both motion and power through drag links to bell cranks whose fulcra are rigidly mounted to the car body. The output arms of the bell cranks drive connecting rods, or links, really, which impart motion and drive power to the door panels near the distal edges of those panels through their mounts on the distal edge backing bean or reinforcement members adjacent the door edges. The linkages, rotate about their base pivot mounts in parallel y-z planes, the axes of the pivots extending in the x-direction.

FIGS. 1*a*-1*d* and 2*a*-2*d* show respective views of examples of rail road freight cars, both indicated as 20. The double illustration is intended to be understood as meaning that the features and aspects of the invention are pertinent to a range of railroad freight cars, rather than a single embodiment. While car 20 may be suitable for a variety of general purpose uses, it may be taken as being symbolic of, and in some ways generic examples of, flow through cars, in which lading is introduced by gravity flow from above, and removed by gravity discharge through gated or valved outlets below. "Flow through", or "center flow" cars may include open topped hopper cars, grain cars, plastic pellet cars, potash cars, ore cars, coal gondolas, and so on. In the embodiments shown, the cars may most commonly be referred to as open top hopper cars. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. In either case car 20 may be symmetrical about both its longitudinal and transverse, or lateral, centerline axes. Consequently, it will be understood that the car has first and second, left and right hand side beams, bolsters and so on. Car 20 of FIGS. 1*a*-1*d* is a shorter car, with steeper sloped hoppers, such as may be used for high density lading with ores such as iron ore. Car 20 of FIGS. 2*a*-2*d* may be a longer, and perhaps slightly taller, car, for lower density lading, and it may have slope sheets inclined at a more gentle angle, as drawn. The end walls may extend to the full length of the car, as in FIGS. 2*a*-2*d*, or be spaced more closely as in FIGS. 1*a*-1*d*.

By way of a general overview, car 20 may have a car body 22 that is carried on trucks 24 for rolling operation along railroad tracks. Car 20 may be a single unit car having releasable couplers at each end, as shown, or it may be a multi-unit car having two or more car body units, where the multiple car body units may be connected at substantially permanent articulated connectors, or draw bars. To the extent that car 20 may carry relatively dense materials, draw bar connections in a unit train might be employed. Car body 22, and the various structural members and fittings described herein may be understood to be typically of metal construction, whether welded or Huck™ bolted, or riveted together, the metal members being most typically steel, stainless steel, or aluminum, as may be appropriate. Some car builders have also used reinforced plastic composites for car elements, and those materials could also be employed where suitable. Car body 22 may have a lading containment vessel or shell 26 such as may include an upstanding wall structure 28 which may have a pair of opposed first and second end walls 30, 32, that extend cross-wise, and a pair of first and second side walls 34, 36 that extend lengthwise, the end walls 30, 32 and side walls 34, 36 co-operating to define a generally rectangular form of peripheral wall structure 28 as seen from above. Wall structure 28 may include top chords 38 running along the top of the walls, and side sills 40 running fore-and-aft along lower portions the side sheets 42 of side walls 34, 36. In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 44, which, as shown in the Figures, may be a straight-through center sill, running from one end of the car body to the other. In the case of a single, stand-alone car unit, draft gear and releasable couplers may be mounted at either end of the center sill. Center sill 44 has first and second, or left and right hand vertical webs 46, 48, a bottom flange 50, and a top flange or top cover plate 52, those four elements being arranged in the conventional manner to define a substantially rectangular hollow tube running the length of the car as shown. Cover plate 52 is carried at a height in the range of something such as 41 to 43 inches above top of rail, such that the coupler and draft gear sit in the coupler pocket with a coupler centerline height for a light (i.e., unladen) car with unworn wheels of 34½ inches above TOR, the standard AAR undeflected coupler height. In a center flow, or flow through car, the upper portion of the car may typically include means by which to admit lading under a gravity drop system. Such an intake 54, or entryway may be a large rectangular opening such as bounded by top chords 38, or the car may have one or more hatches, whether covered or uncovered.

Looking at the structure generally, car 20 has two hoppers, or hopper assemblies, or hopper sections, identified generally and generically as a first hopper 58 and a second hopper 60. Each hopper has, an end slope sheet 62 sloped in the longitudinal direction, and an intermediate slope sheet 64 also sloped in the longitudinal direction. These slope sheets slope upwardly, and away from, a respective first or second hopper discharge section 66, 68. As may be appreciated, the interior or intermediate slope sheets 64 of hoppers 58 and 60 run upwardly and inwardly toward each other, more or less symmetrically, to meet at what is, roughly speaking, a common apex. More precisely, they engage opposite sides of a ridge plate assembly 70 that runs cross-wise between side walls 34, 36. Ridge plate assembly 70 may be made substantially as shown and described in my US Patent Publication 20100132587 and lies along the central plane of car 20. It is not necessary that end slope sheets 62 be inclined at the same angle as intermediate slope sheets 64. Those slopes may be different as shown in FIGS. 2*a*-2*d*, in which the slope of end slope sheet 62 is substantially shallower than the slope of the intermediate slope sheets 64. It may be noted that a flat member, or gusset, or plate 72 is mounted beneath ridge plate assembly 70 between the two adjacent intermediate slope sheets 64, such that a triangular tube is formed that extends across car 20 from side wall 34 to side wall 36.

In the embodiment shown, the lower margins 74, 76 of slope sheets 62 and 64 terminate at a level corresponding to the height of side sills 40, such that margins 74, 76 and side sills 40 co-operate to define a generally rectangular opening giving on to hopper discharge sections 66, 68 of first hopper 58 or second hopper 60 respectively. A lateral stiffener in the form of an hollow section beam 78, 80 runs cross-wise from side sill to side sill along lower margin 74, 76. Each hopper discharge section 66, 68 has a four sided shape that includes first and second side wall members 82, 84 that depend downward on an inward decline from side sills 40, and first and second end wall members 86, 88 that run cross-wise across the car, and may extend in substantially vertical planes downwardly from margins 74, 76 respectively. The bottom margins 92, 94, 96 and 98 of wall members 82, 84, 86 and 88 define a generally rectangular opening 90. Egress of lading from opening 90 is controlled by governors, namely outlet doors or gates, indicated generally as first and second (or left and right hand) doors 100, 102. These doors 100, 102 may be symmetrical, such that a description of one serves also to describe the other.

Elevated Full Length Side Sills

Side walls 34, 36 act as long deep side beams 104, 106 that carry the vertical loads of hoppers 58, 60, said walls having upper flanges formed by top chords 38, bottom flanges formed by side sills 40 and webs defined by side sheets 42. Side sheets 42 are reinforced by reinforcements in the nature of vertical posts 56. The vertical loads transferred into the side beams are then carried into center sill 44 at the location of the main bolsters 108 at the truck centers. Main bolsters 108 each include an upper, or main, flange 110, a lower stub flange 112, and a stub web 114.

In this structure then, although there is a straight-through, full-length side sill 40 that runs continuously and at constant elevation from main bolster to main bolster, side sill 40 is not carried at the same height as center sill 44, or even at the same height as the cover plate 52 of center sill 44. Rather it is carried in a super-elevated location substantially above the height of top cover plate 52. The magnitude of the super-elevation is roughly comparable to the depth of center sill 44, and may be taken as somewhere in the range of half that height to two times that height, or somewhere in the range of perhaps 8 to 20 inches.

Center Sill Penetration Passes Through Discharge Section

Figure 3A:
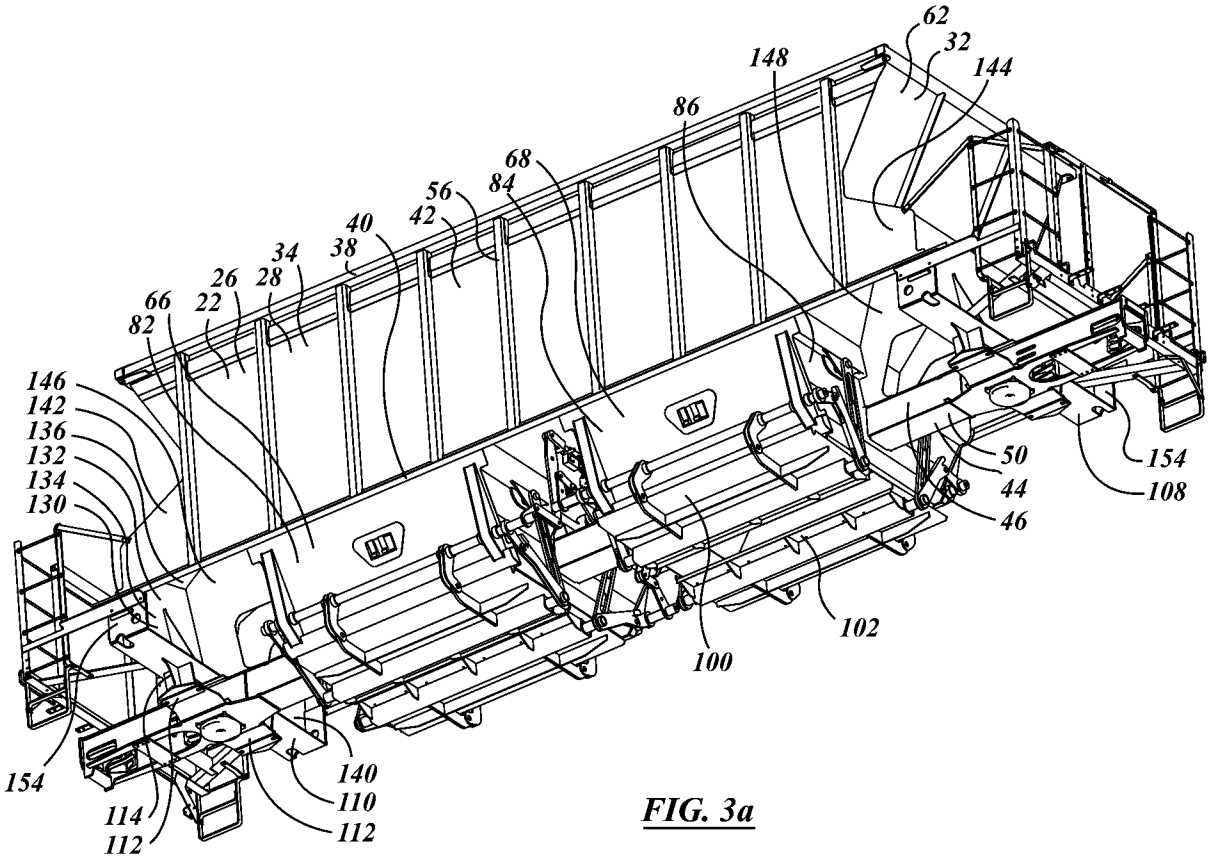
FIG. 3*a* is a perspective view, from underneath and to one end and to one side of the railroad freight car of FIG. 1*a* with the trucks, couplers and draft gear removed.
Figure 3B:
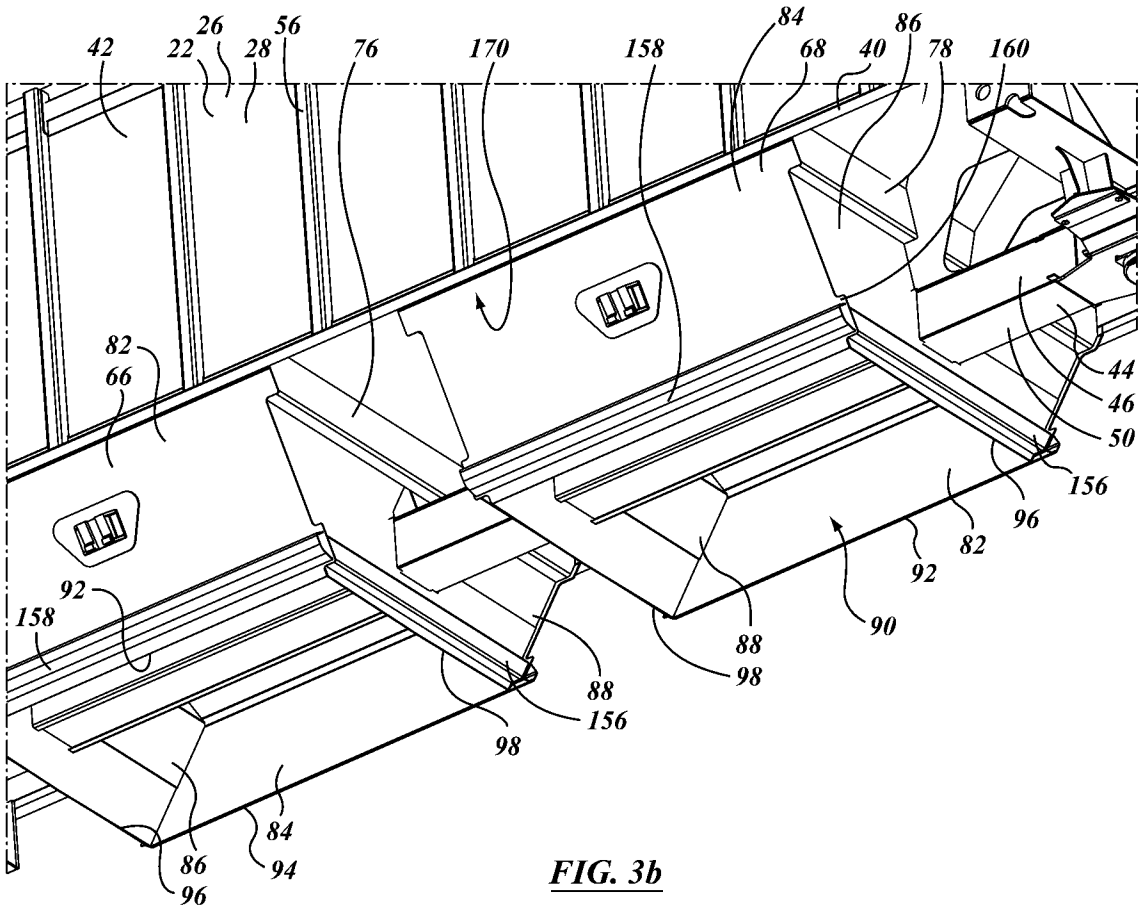
FIG. 3*b* is an enlarged view, from a similar viewpoint, of a portion of the railroad freight car of FIG. 3*a* with the hopper door assemblies removed.
Figure 3C:
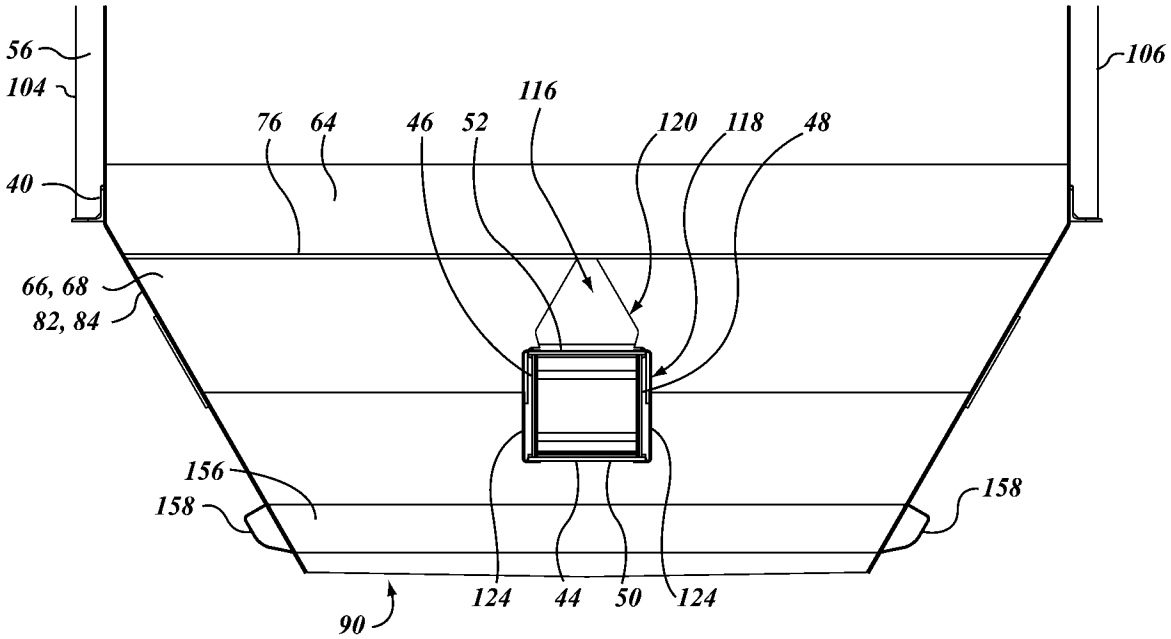
FIG. 3*c* is an end view of a hopper discharge section of one of the hoppers of the railroad freight car of FIG. 3*b;*
Figure 3D:
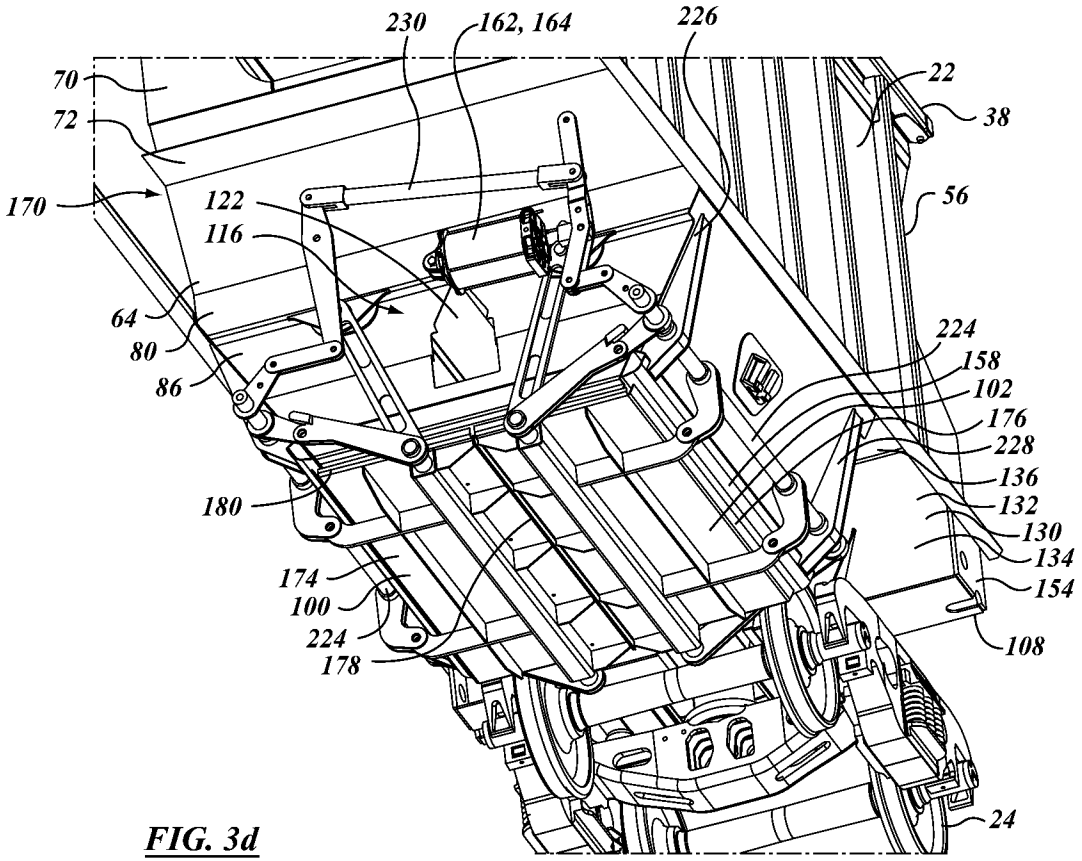
FIG. 3*d* is a perspective view, from underneath, near the car centerline and to one side of one hopper of the railroad freight car of FIG. 1*a*, foreground structure being removed to show the relationship of door operation members with the discharge doors in a closed position at the driven end.
Figure 3E:
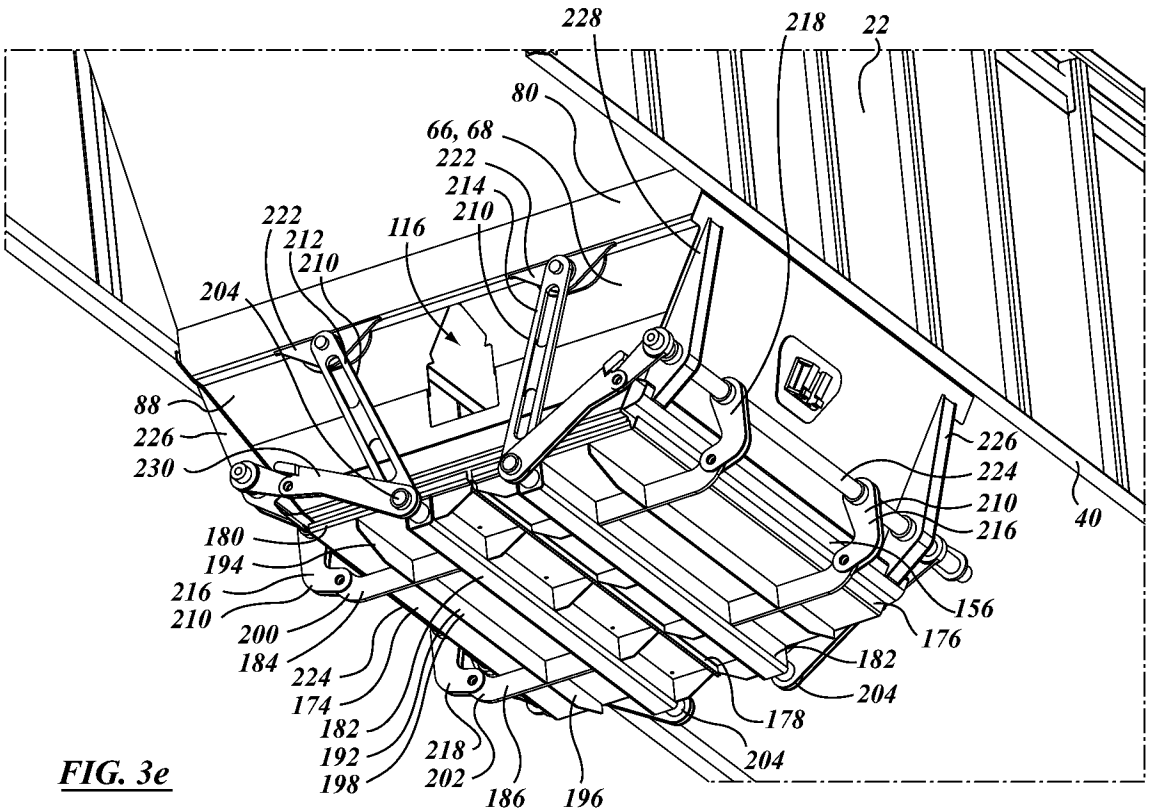
FIG. 3*e* is a view of the door operation members with the discharge doors in the closed position seen from the slave, or follower, end opposite to that of FIG. 3*d;*
Figure 3F:
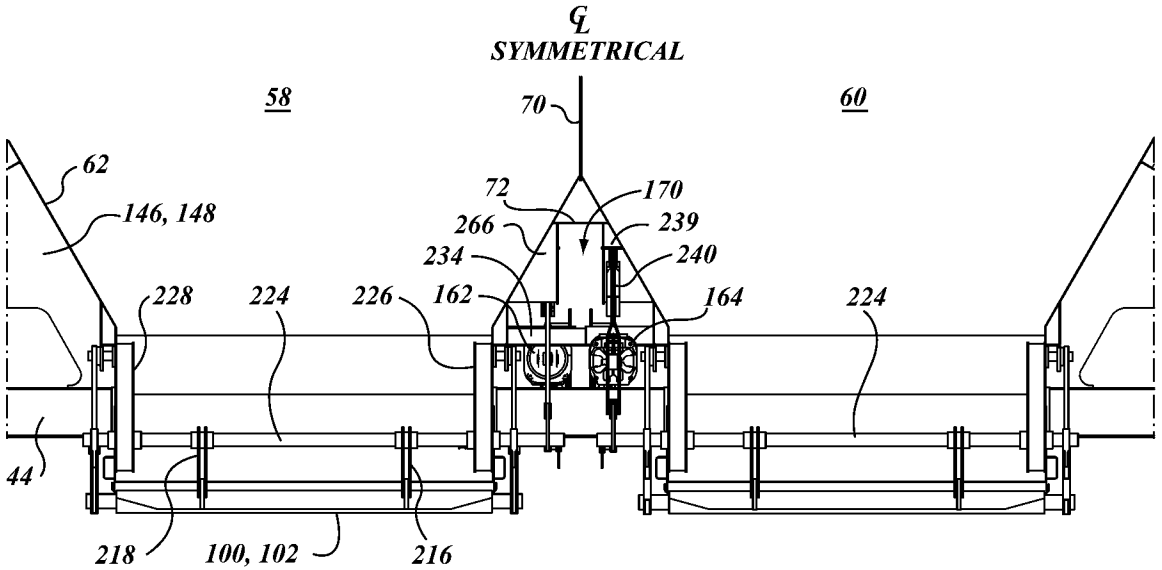
FIG. 3*f* is an enlarged side view detail of the actuator installation of the railroad freight car of FIG. 3*a;*
Figure 3G:
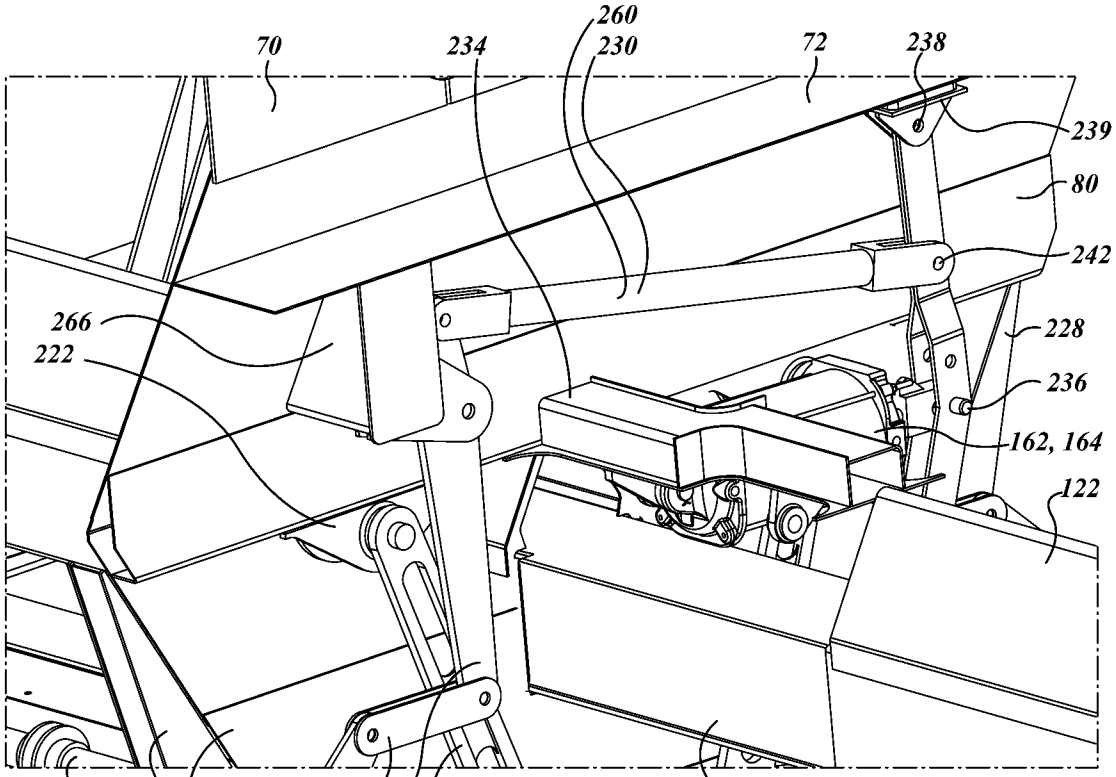
FIG. 3*g* is an enlarged detail, taken in perspective with the foreground actuator and structure removed, of the actuator installation of the railroad freight car of FIG. 3*f;*
Figure 4A:
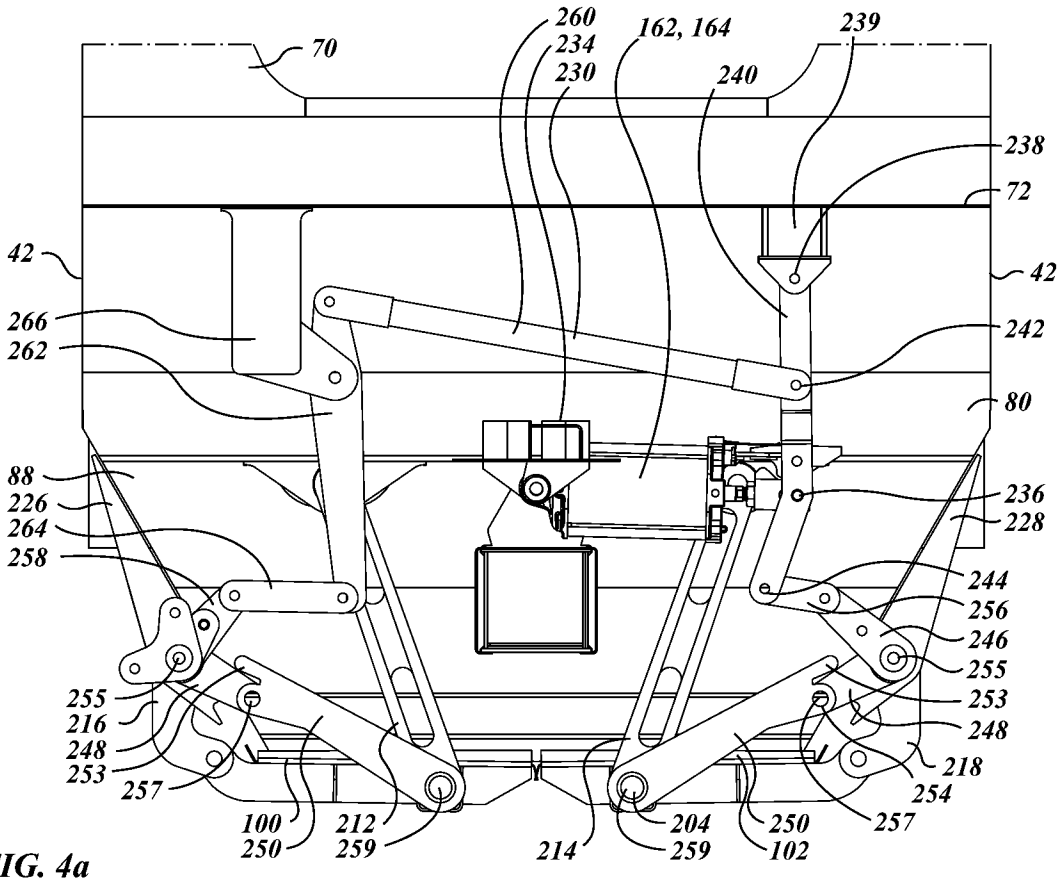
FIG. 4*a* is a view taken on '4*a*-4*a*' of FIG. 1*a*, with trucks removed, showing the door operating apparatus in the fully closed condition.
Figure 4B:
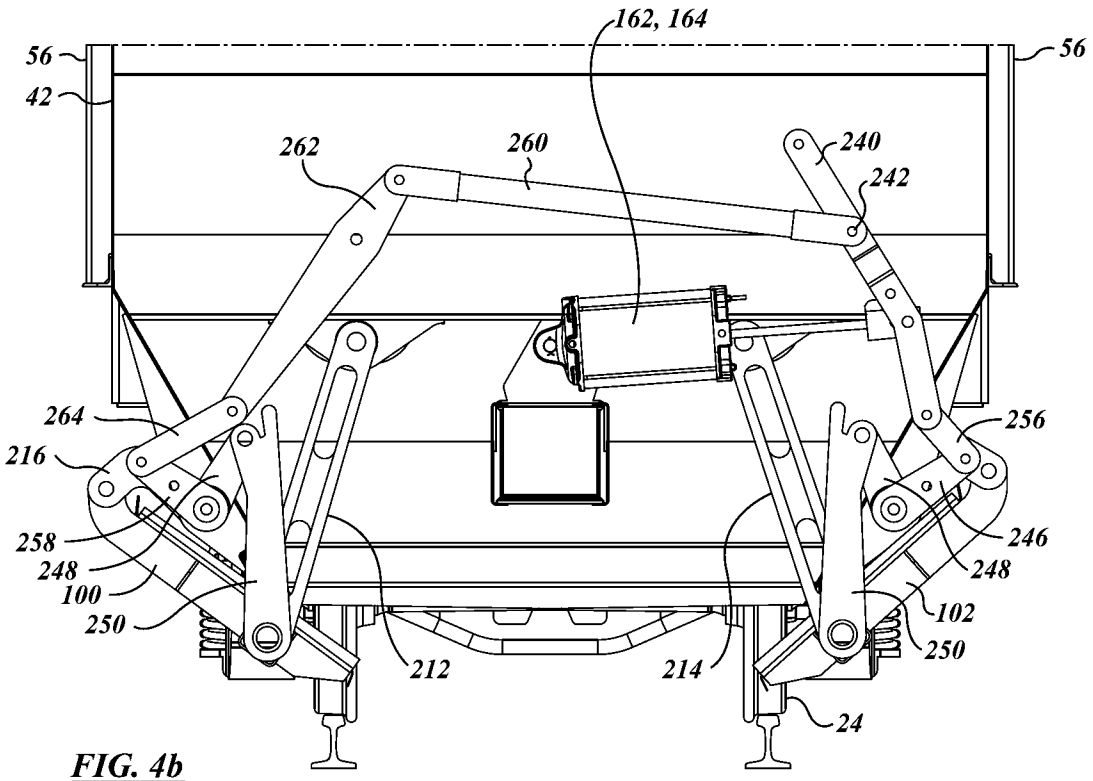
FIG. 4*b* is the same view as FIG. 4*a*, with the door operating apparatus in the fully open position.
Figure 4C:
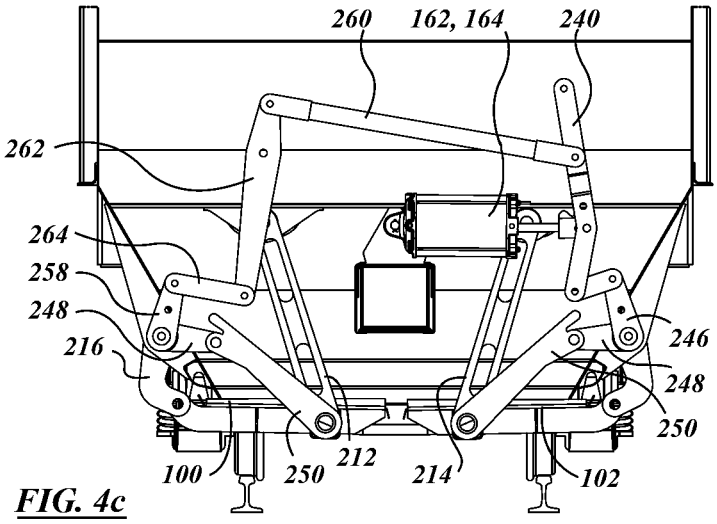
FIGS. 4*c*-4*f* show an evolution of the door opening mechanism of FIG. 4*b* moving from a closed position to an open position at the 20%, 40%, 60% and 80% increments.
Figure 4D:
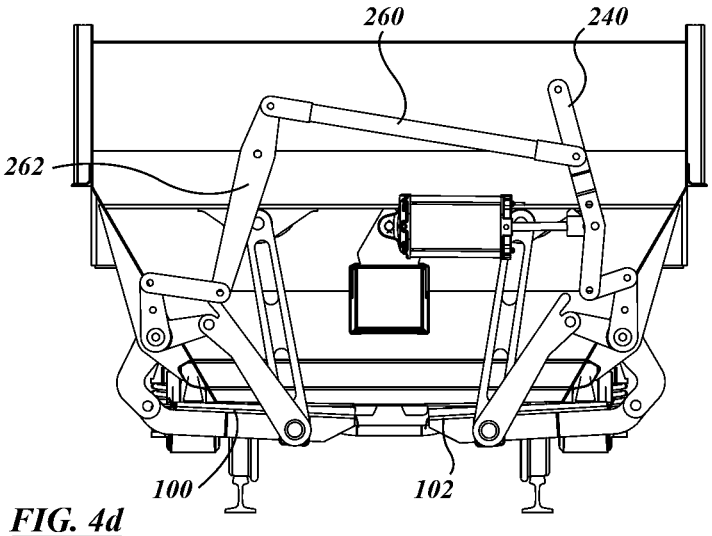
Figure 4E:
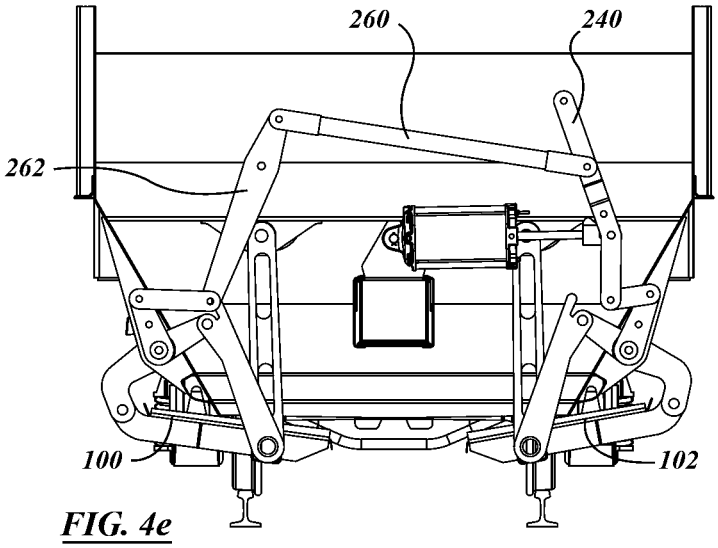
Figure 4F:
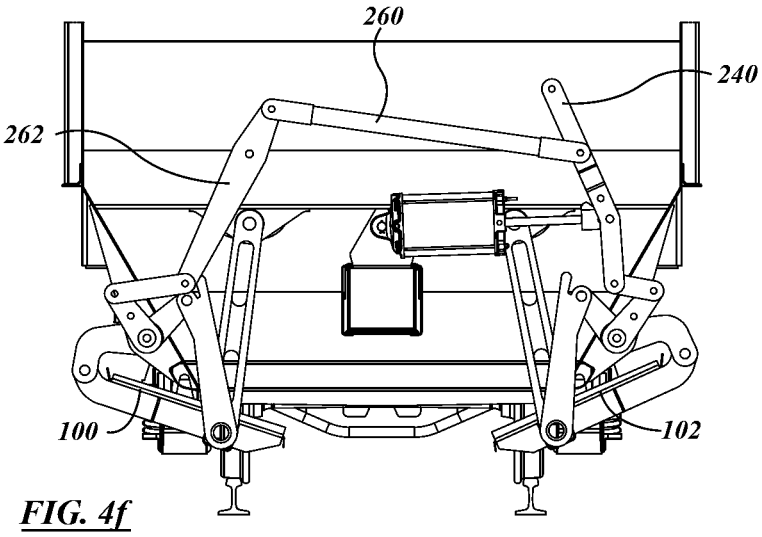

In a related point, car 20 is such that the lower margins 74, 76 of the end and internal slope sheets 62, 64 are spaced upwardly from center sill 44, by roughly the same amount as the lowermost flanges of side sills 40 are spaced upwardly from the uppermost flange of center sill 44. Another way of expressing this is to note that centersill 44 passes clear though discharge sections 66, 68 of hoppers 58, 60 at a level at which center sill cover plate 52 is below the upper margins of the end wall plates, i.e., end wall members 86, 88 of each respective discharge section, be it 66 or 68. Moreover, as shown the bottom of center sill 44, namely bottom flange 50, is carried at a height that is clearly well above the level of bottom margins 92, 94, 96, 98 of discharge section end wall members 86, 88, and of discharge section side or slope sheets or members 82, 84. Thus, as will be described below, center sill 44 is not a participating member in terms of establishing the door closure boundary or periphery; or of acting as a support for a door lip, or as a hinge support. Within the confines of discharge section 66 itself (or 68, as may be), i.e., where lading is carried, center sill 44 does not participate as a member of the closure (i.e., the doors) or as structure supporting the closure, or as structure supporting the closure mechanism or drive train. As can be seen in FIGS. 3*c* and 3*d*, the penetrations 116 in the fore and aft end plate walls 86, 88 of each discharge section 66 or 68 are substantially pentagonal, with a generally rectangular lower portion 118 of a size and shape suitable for accommodating center sill 44, and a generally triangular upper portion 120 corresponding to the shape of the center sill shroud, or flow divider, or roof, or protector, or housing 122 that extends longitudinally above center sill 44 and divides the lading outflow to pass to either side of center sill 44. The longitudinally running side shrouds of center sill 44 are indicated as 124.

End Wall Defines Deep Lateral Beam

An end wall, or end wall assembly 130 of car 20 includes a deep, predominantly upwardly extending, transversely running shear web, member, panel or wall, 132. Wall 132 has a lower portion 134 and an upper portion 136. Lower portion 134 lies in a predominantly vertical cross-wise plane. Upper portion 136 is bent relative to lower portion 134, and extends on an upwardly inclined plane to meet, and mate with, end slope sheet 62. The lower margin of wall 132 mates with upper or main flange 110 of main bolster 108. In effect, end wall top chord 138, end slope sheet 62, beam 80, wall 132, and flange 110 co-operate to define a deep beam or deep beam assembly 140, that extends across car 20 from side sill to side sill. The ends of beam 140 are capped by the wings, or shear web panel extensions 142, 144 of the side wall shear web sheets 42. Further, support webs in the nature of elephant ears 146, 148 meet center sill cover plate 52 directly above respective center sill webs 46, 48, and are angled on an outwardly splayed slope slightly away from each other, extending upwardly to meet and reinforce end slope sheet 62 and end wall 132, thus providing load paths by which vertical portions of the shear load from side beams 104, 106 and the lading are resolved into center sill 44. Main bolster 108 has end cap webs 154 that meet and run upwardly from main or upper flange 110, and run against the transversely outboard edge of lower portion 134, between flange 110 and side sill 44, forming a T-section.

Large, Low, Substantially Horizontal Hopper Discharge Opening

It may also be noted that the lower margins of the stationary structure of the hopper discharge sections are reinforced by hollow structural sections, those on end members 86, 88 being identified as 156 and those on the sloped, laterally downwardly convergent side wall members 82, 84 being identified as 158. As can be seen in FIG. 3*b*, side sheets 82, 84 have members or extension portions identified as ears, or wings 160, that extend over, and cap, the ends of the hollow sections 78, 80 and 158 at the top and bottom margins of hopper discharge sections 66, 68. Further, considering the rectangular picture frame defined by the lower margins of the four sheets that define the rectangular discharge opening 90, several feature may be noted. First, the opening is longer than wide. In one embodiment the length of the doors may be over 100 inches, and may be about 103 inches, such that two hoppers have a combined opening length of over 200 inches. In this car of FIGS. 1*a*-1*d* the truck center distance may be less than 400 inches, and in one embodiment is between 380 and 385 inches. Thus the ratio of door length to truck center length is greater than 1:2, and may be in the range of as much as roughly 7:13 In the embodiment of FIGS. 2*a*-2*d* the length is even greater, being roughly 155 inches, such that two doors give a total door length of more than half and in one embodiment as much as roughly ⅝ of the truck center spacing. Nonetheless, the width of the opening is more than 60 inches wide, and in one embodiment is approximately 70 inches wide. Expressed differently, the opening is more than half the overall width of the car, and in one embodiment is roughly 6/11 of the width of the car. Expressed differently, the width is more than the gauge width of the tracks, and, in some embodiments may be in the range of 6/5 to as much as 5/4 times the gauge width. Furthermore, the height of the opening above Top of Rail is very low. It need not be that the entire opening, or the periphery of the opening defined by lower margins 92, 94, 96, 98 is planar or lies in a unique horizontal plane. For example, the opening of car 20 is not precisely planar, but is angled slightly upwardly away from the car centerline, the angle in one embodiment being of the order of less than 3 degrees as shown in FIG. 3*c*. However, taking the opening as being substantially planar and horizontal, the height of the midpoint of the periphery of the opening on the centerline of car 20 the structure may in one embodiment lie as little as 8 inches above top of rail. That is to say, the opening width of the discharge over the mating double doors 100, 102 is more than six times, and in one embodiment more than eight times, the clearance height from top of rail to the lip of the opening of the stationary structure, and in one embodiment is more than 8½ times the clearance height (i.e., 70" width, 8" clearance). These various ratios are measures of, or proxies for a physical property of functional significance, namely they are measures of the extent to which a very large, substantially horizontal gate opening permits the car to have a low center of gravity while laded, potentially permits the car to have a larger volume of lading than otherwise, (depending on the density of the lading); permits the lading to be discharged more quickly given that the opening is larger and at the same time lower than the center sill, and permits the lading to be discharged with more accuracy and less spread than might otherwise be the case if discharged from a greater height.

Internal Machinery Accommodation Between Hoppers

In terms of stationary structure, it may be recalled that interior slope sheets 64 of hoppers 58 and 60 meet at ridge plate assembly 70. As such there is a sheltered machinery space 170 defined between the two hopper discharge sections beneath, of in the lee of, interior slope sheets 64 of adjacent hoppers 58, 60, and, indeed, below plate 72 which forms the bottom closing member of the triangular cylindrical tube. Although this description is written in the context of a car having two hoppers, the same commentary would apply to a car having any number of hoppers greater than one where the internal slope sheets of two adjacent hoppers meet to form a somewhat protected space. In existing open topped hopper cars the space between the center sill top cover plate and the undersides of the slope sheets is often where so called "elephant ears" or triangular planar shear plates are located, those planar shear plates having one vertex running along the center sill cover plate over one of the center sill webs, a second vertex running upwardly on a diagonal along the back of one of the intermediate slope sheets and a third vertex running upward on a similar diagonal on the back of the other intermediate slope sheet. In the instant car 20, machinery space 170 is free of such shear plates or elephant ears, or planar web members, such as would otherwise obstruct the space.

Since machinery space 170 is unobstructed, door drives in the nature of pneumatic cylinders, or pneumatic actuators, 162 and 164 may be located in the accommodation so defined. Location of actuators 162, 164 in this accommodation may tend to mean that the actuators are not fit into a tight or difficult machinery space over one of the end sections of the car, competing for space with the brake reservoirs or other equipment. It may also mean that there is better access for servicing and maintenance, and it may mean that the drive train to operate the doors is shorter and more direct than it might otherwise be, because the actuator is immediately beside the mechanism that it is intended to drive, and, in a substantially transverse installation, the actuator is aligned predominantly in the direction of action of force that is desired, making a more compact drive train generally.

Door Structure

The structure of the door panels is shown in FIG. 3*d*. As noted, the left and right hand doors 100, 102 are symmetrical, such that a description of one is equally a description of the other. The main portion of door 100 (or 102, as may be) is a sheet or pan 174, which may have a turned-up proximal flange 176 and a turned-down distal lip 178, as indicated. Door pan 174 may also have turned up lateral edges 180, the door length (in the x-direction, or longitudinal direction) of car 20 being suited to the opening defined by the lower margins of the hopper discharge section, be it 66 or 68, the upturned lateral edges seating to either side of the fore-and-aft lower margins of the hopper discharge section to form a seal therealong when the door is closed. Pan 174 is reinforced by a long-direction hollow channel 182, oriented parallel to the x-direction of the car. Channel 182 is welded toes-in to form a hollow section. Pan sheet 174 is also reinforced by, and carried by, first and second reinforcements 184, 186 that run across the outward side thereof from the proximal edge to channel 182. Web continuity gussets (not shown) may be mounted within channels 182, and reinforcement continuations or tips, in line with reinforcements 184, 186, extend from channel 182 to the distal margin of door 100, terminating at down-turned distal lip 178. A further longitudinal stringer 192 runs parallel to channel 182 mid-way between channel 182 and proximal edge flange 176. Stringer 192 is made in three parts, namely two partially tapered end portions 194 and 196 to the outside of reinforcements 184, 186 and a center portion 198 extending between reinforcements 184, 186, members 194, 198 and 196 being aligned in a plane cross-wise to reinforcements 184, 186. The distal ends of reinforcements 184, 186 extend beyond proximal edge flange 176, and curl upwardly partially therearound to define mounting lugs 200, 202. Further, spindles, or stub shafts 204 are mounted at the ends of C-channel 182 and define connection interfaces, or connection points for both the door suspension members and the door drive train.

Door Linkages

Doors 100 and 102 are suspended from a set of pivotally movable members or links such as may be identified as door support linkages 210. Those linkages include a pair of first and second, near end and far end distal door linkages, or arms 212, 214, and a pair of first and second, near and far, proximal, short, door linkages, or arms 216, 218. As may be noted, the distal linkages, or arms, 212, 214 are longer than the proximal arms 216, 218. Arms 212, 214 have respective first end pivotally mounted to upper lateral hopper section support member 80 at mounting lugs, or feet, 222. This is the stationary, or reference or datum end of the link. The other end of arms 212, 214 is the pivot mount at the connection interface defined at stub shaft 204, which may be termed the distant or swinging end. Similarly, the "fixed" or base, or reference, end of short arms 216, 218 is mounted to a rotational angular motion and torque transmitting member identified as torque tube 224, and the "free" or swinging ends of short arms 216, 218 pick up on mounting lugs 200, 202. Short arms 216, 218 are not rigidly fixed to torque tube 224, but rather are mounted to rotate independently of it. Torque tube 224 is itself mounted for rotation to a pair of first and second (or near and far) mounting fittings or brackets, or pedestals, or reinforcement members or lugs 226, 228, which may themselves have the form of tapering hollow channel sections mounted toes-in to the outside face of the inwardly inclined side sloping sheets of the hopper discharge sections, those hollow sections also defining discharge section reinforcements extending from one end connected to side sill 40, and a second, lower end welded to lower edge reinforcement 156.

As may be noted, the resultant structure defines a four-bar linkage. The first bar, or base, or datum, is the stationary structure whose position is rigidly fixed as part of the car body, namely the stationary structure of discharge section 66, 68, which includes the footings of mounts of the linkages. The long arm pair of arms 212, 214 forms the second bar of the four bar linkage. The short arm pair of arms 216, 218 forms the fourth bar of the four bar linkage, and the door panel itself forms the third bar of the four bar linkage. As may be noted, this four-bar linkage is movable between a first position (namely the closed position, shown in FIG. 4*a*) and a second position (namely the fully open position shown in FIG. 4*b*).

In this motion, the long arm link moves through a significantly smaller angular displacement than the short arm link, the long arm moving through roughly 35 to 45 degrees of arc (approximately 40 degrees), and the short arm link moving through 120 to 150 degrees of arc (approximately 135 degrees). At the starting position of the motion, both the short and long arms are on angles inward of vertical, such that as the motion begin, both the short and long arms move toward a vertical orientation, and, in so doing, their "free" pivot interfaces move in a direction of motion that has both an outward and downward component of motion. I.e., dz/dy at both free pivot interfaces is negative. Thus, since there is a −z component of motion, the initial motion serves to "lift" the pan, i.e., move it away from the seat, while the door is also moving predominantly laterally outboard in the +y direction. In this initial stage of motion, the absolute value of dz/dy is also considerably less than 1—i.e., the motion is more strongly horizontal than vertical. This horizontal predominance increases as the swinging arms move toward their respective vertical positions. Once past the vertical, the respective pivot connections begin to move upward while moving laterally outward. The angular displacement of the short arm is more rapid, and its motion is soon predominantly upward (dz/dy>1), and continues so throughout the remainder of the stroke. While this occurs, the longer arm continues its predominantly horizontal motion on a less rapidly changing angular displacement and less strongly positive dz/dy. The effect is that the door panel itself tilts from a very nearly completely horizontal condition to a tipped, inclined position. At the end of the motion, the inside lip of the door may be positioned substantially directly above the rail, or just laterally shy of the inside of the rail bullnose, such that lading exiting the hopper discharge may tend to fall between the rails.

Drive Train

The motion of the four bar linkage in the opening direction may be commenced by a drive train 230, the same drive train being used to close the doors in the other direction once the lading has been discharged.

The drive train includes drive actuators, 162, 164 noted above. Those actuators may be cylindrical rams, such as pneumatic cylinders 166, 168 previously noted. One end of each cylinder is pivotally mounted between a base, or reference, or datum or body lug mounted to actuator support beam 234. The second end of each actuator is pivotally mounted to an output lever 240 at an output pivot connection 236. Output lever 240 has a fixed pivot 238 mounted on a pedestal 239 carried on the underside of the ridge tube beam bottom gusset plate 72. Output lever 240 has two other pivotal connections, 242 and 244. Pivotal connection 242 is located roughly mid way intermediate fixed pivot 238 and output pivot connection 236. Pivotal connection 244 is located at the distal end of output lever 240, radially more distant from fixed pivot 238 than is output pivot connection 236.

A driving arm or crank 246 is pivotally mounted to the near end of torque tube 224, and can turn freely with respect thereto. A connecting member in the nature of a drag link or push rod 256 has a first pivotal connection to output lever 240 at connection 244, and a second pivotal connection at the distal tip of crank 246. The drive train includes two further members, the first being a driven arm 248 and the second being a follower or slave link 250. In normal, or automatic, or power-driven mode, driven arm 248 is connected to crank 246, such that when crank 246 turns, driven arm 248 turns through the same angle and transmits force and motion to slave link 250, which, in turn, drives the door, be it 100 or 102. Motion of connection 236 caused by actuator 162 (or 164, as may be) will therefore necessarily cause crank 246 to move. As may be understood, in tripping door 100 (or 102) to open, member 256 acts in compression as a connecting rod or push rod. In closing door 100, member 256 acts in tension as a drag link. Follower 250 is pivotally joined at a connection 254 at one end to the distal tip of driven arm 248, and also pivotally connected to stub shaft 204. Rotation of driven arm 248 will move the location of connection 254, which will, in turn cause stub shaft 204 to move, opening or closing door 100 (or 102). Follower 250 also has an over-center lock in the form of a finger or abutment 253. When driven arm 248 is moved to an over center condition with respect to follower 250 (i.e., the pivot axes at 255, 257 and 259 pass through a condition of planar alignment) abutment 256 engages driven arm 248 preventing further motion. As the near end of door 100 (or 102) moves, consequent motion occurs in the links of the four bar linkage of the door. Torque tube 224 may tend to force driven arms 248 at both ends of torque tube 224 to move in unison, and thereby to discourage twisting of the door.

A similar crank arm 258 is mounted to torque tube 224 of door 102, and functions in the same manner. Force and motion are transmitted to crank 258 from output lever 240 by means of a first transmission member in the nature of a slave link 260; a second member in the nature of a lever 262; and a third member in the nature of a drag link or push rod 264. Lever 262 is carried by a fulcrum mount, or pedestal 266 that is, itself, like pedestal 239, mounted to plate 72. Motion imparted to lever 262 by slave link 260 above the fulcrum results in motion in the opposite translational direction in drag link 264. Thus outboard motion of the cylinder of actuator 100 results in laterally outboard motion of both drag links 256 and 264 in opposite directions on their respective sides of car 20, such that doors 100 and 102 operate at the same time in a coordinated, substantially symmetrical manner. It may be noted that output lever 240 is also a force divider in the sense that the single force (and motion) received from actuator 100 is split and distributed to the right and left hand portions of the drive train. Notably, at no point during the operation of the linkages does any part of the door operating mechanism swing outside the AAR envelope of either AAR Plate B, Plate C, or Plate F by more than 3 inches in the widthwise direction. Expressed differently, no part of the apparatus swings laterally more than 3" proud of the side walls of the car.

Secondary Lock

Figure 5A:
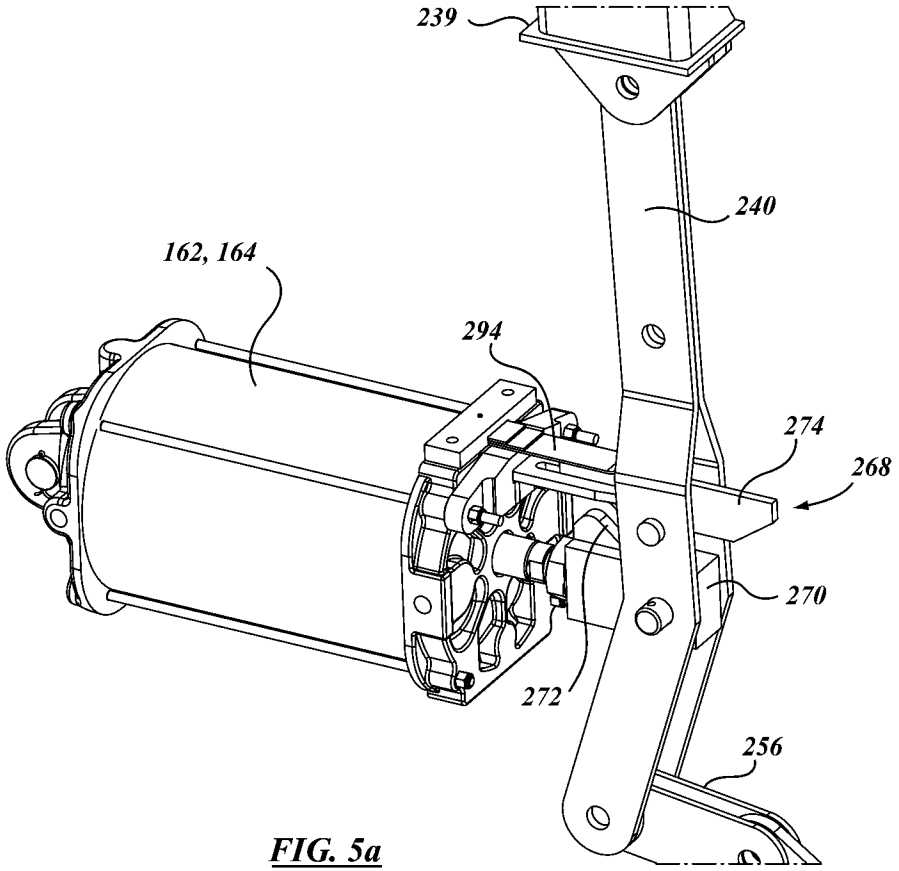
FIG. 5*a* shows an isometric view of the secondary lock arrangement and one of the actuators of the railroad freight car of FIG. 1*a;*
Figure 5B:
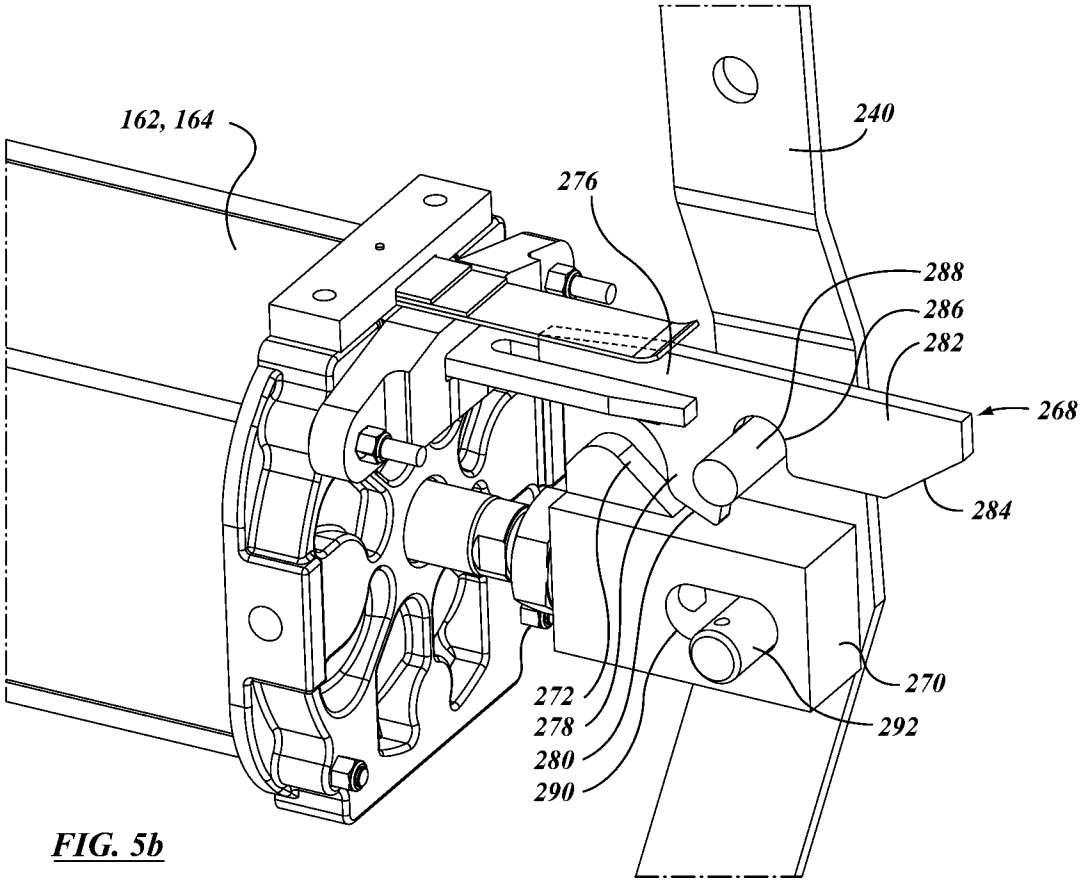
FIG. 5*b* shows an enlarged detail of the secondary lock arrangement of FIG. 5*a* with the nearside yoke half and biasing spring removed for clarity.

As in previous cars, the drive train of car 20 has a secondary lock assembly 268 to prevent unintended opening of doors 100, 102 other than when actuator 100 is energized to cause the doors to open intentionally. As shown in FIG. 5*a*, output lever 240 is a bifurcated member that defines a yoke or a clevis, with the block of the cylinder head 270 mounted in double shear between the arms of the bifurcation. A cam 272 is mounted atop the proximal end of cylinder head 270. A secondary lock cam follower 274 has a trunnion mount affixed to the face of actuator 162, 164 the trunnion mount permitting cam follower to rotate in a vertical plane such that the extended finger and lock 276 can ride on cam 272. The back of the "thumb" or downwardly extending portion 278 is chamfered as at 280. The extended finger, or portion 282 is also chamfered as at 284. The inner end, or crotch of the extended finger or portion 282 has a relief or accommodation or detent 286 formed therein defining a locking seat for a mating locking pin 288 mounted through the bifurcations of lever 240. As may be noted, the slot 290 in cylinder head 270 provides a measure of lost motion, or slack, between the cylinder head and the pivot connection pin 292 of lever 240. When the system is inactive a biasing member, in the nature of a leaf spring 294, urges portion 282 downward, thereby discouraging disengagement of detent 286 from locking pin 288.

When actuator 100 is energized to move cylinder head 270 forward, cam 272 rides against chamfer 280, over-riding the bias of spring 294, causing cam follower 274 to lift, and thereby releasing lock pin 288 from accommodation 286. With cam follower 274 thus raised, cylinder head 270 continues forward to bear against pin 292, which ultimately results in force and motion being transmitted through the drive train to trip open doors 100, 102.

Position Indicator Assembly

It is often difficult to ascertain whether hopper doors are fully closed. To that end, considering FIGS. 6*a* to 6*e*, car 20 has a door position indicator assembly, indicated generally as 300. Indicator assembly 300 may be mounted to one side of reinforcement assembly, or lug 226 (or 228, as may be). Torque tube 224 has a positing index, or pointer or finger, or cam or abutment, or indicator actuator, however it may be termed, shown as 302. Indicator actuator 302 may have the form of a stub or nipple or short section of round bar 304 welded to a two part clamp 306. The position of clamp 306 is adjustable, and, when correctly adjusted, clamp 306 may be fixed in place. It may be fixed permanently by welding once correctly adjusted, or may be fixed in place with mechanical fasteners.

Looking inside assembly 300 by removing front plate 308, we see that there is a back plate 310 and a partial peripheral wall 312. There is also a first member or an input member or input lever 314, a second member, or and output member, or output lever or arm, or annunciator 316, and a biasing member, such as a leaf spring 318. The first or input lever 314 is mounted on a pivot or fulcrum 320, there being a first arm, or short arm 322 extending to one side of fulcrum 320, which provide the interaction interface with indicator actuator 302. Input lever 314 also has a second or long arm 324 which extend from fulcrum 320 away from short arm 322. Arm 324 is longer than arm 322, such that input motion at 322 is amplified by arm 324. Long arm 324 has an intermediate hooked finger 326 mounted to engage biasing member 318 on clockwise motion of arm 324. The effect is that biasing member 318 is a return spring, or reset spring that will tend to bias lever 314 to its inactive, or retracted, position. Long arm 324 also has a second finger, horn, or curved end portion 328 whose distal extremity picks up on, and bearing against, output member 316. Output member 316 has an arm 330 that is bent into an upside down U-shape. A first leg 332 of the U is pivotally connected to a pivot point or fulcrum 334. At the end of the second leg 336 of the U there is a toe, or fob, 338 with a web or weight 340.

Given that fulcrum 320 is intermediate the two ends defined by first and second arms 322 and 324, counter-clockwise motion of bar 304 against short arm 322 will result in clockwise rotation of input lever 314 about fulcrum 320, thereby urging end portion 328 of long arm 324 to allow first leg 332 to move to its most clockwise position. When the door is opened, round bar 304 moves away from, and no longer engages, input lever 314. The action of return spring 318 may tend to urge output member 316 to pivot counter-clockwise about fulcrum 320, with the result that fob 338 moves from its first, passive, or inactive "door closed" condition or position (shown in FIG. 6*d*) to its second, activated or "door open" condition or position, shown in FIG. 6*e*).

Manual Operation of Doors

Under some conditions, it may be desirable to be able to cycle the doors (i.e., open and close them) manually if, for whatever reason, the normal powered system either will not work or is not to be used. The ability to do this from trackside may also be desirable. To that end, car 20 may be equipped with a manual door operation apparatus, indicated generally as 350.

Figure 6A:
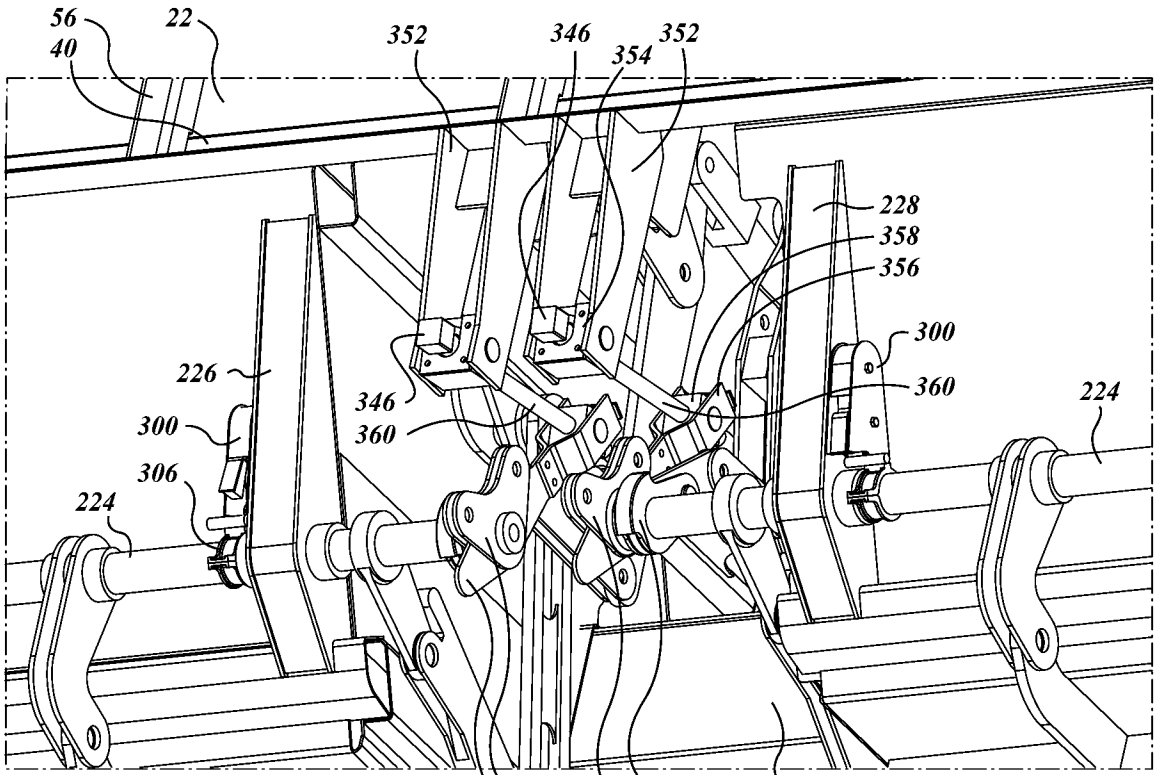
FIG. 6*a* is a perspective view, from below and to one side, of a position verification assembly and of a manual release mechanism for the doors of the railroad freight car of FIG. 1*a;*
Figure 6B:
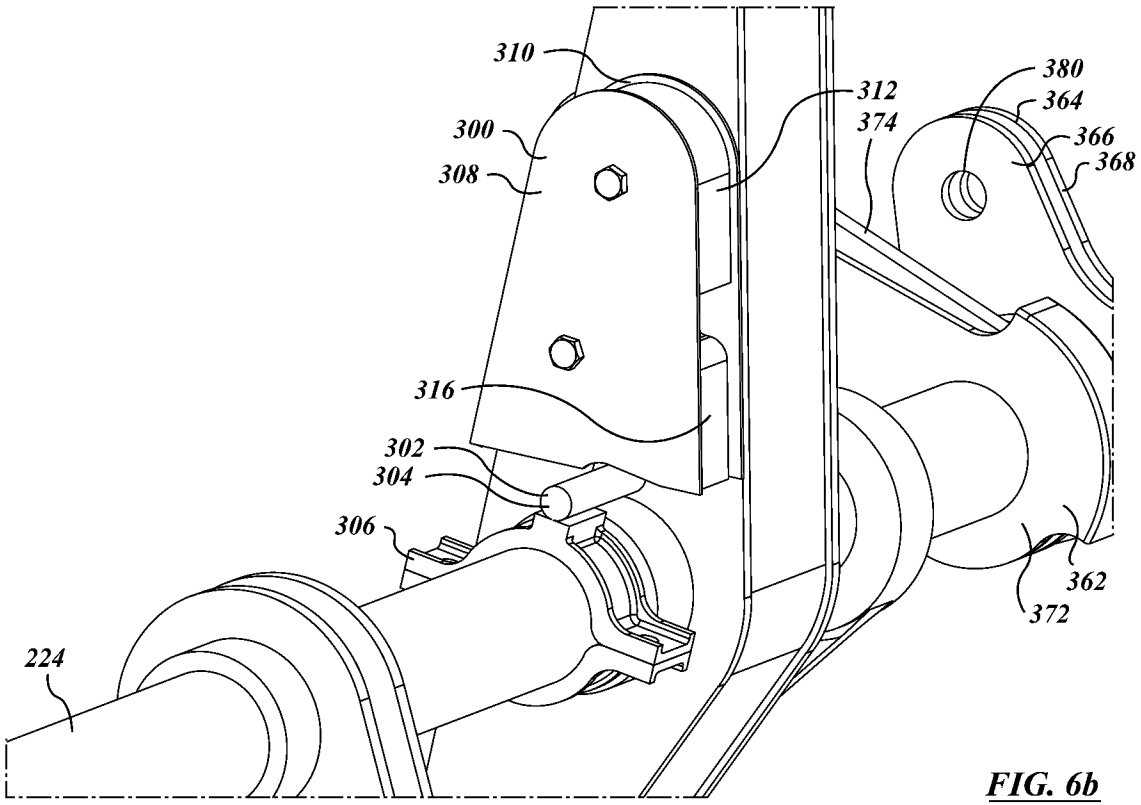
FIG. 6*b* is an enlarge detail of the position verification assembly of FIG. 6*a* in the doors closed an locked position.
Figure 6C:
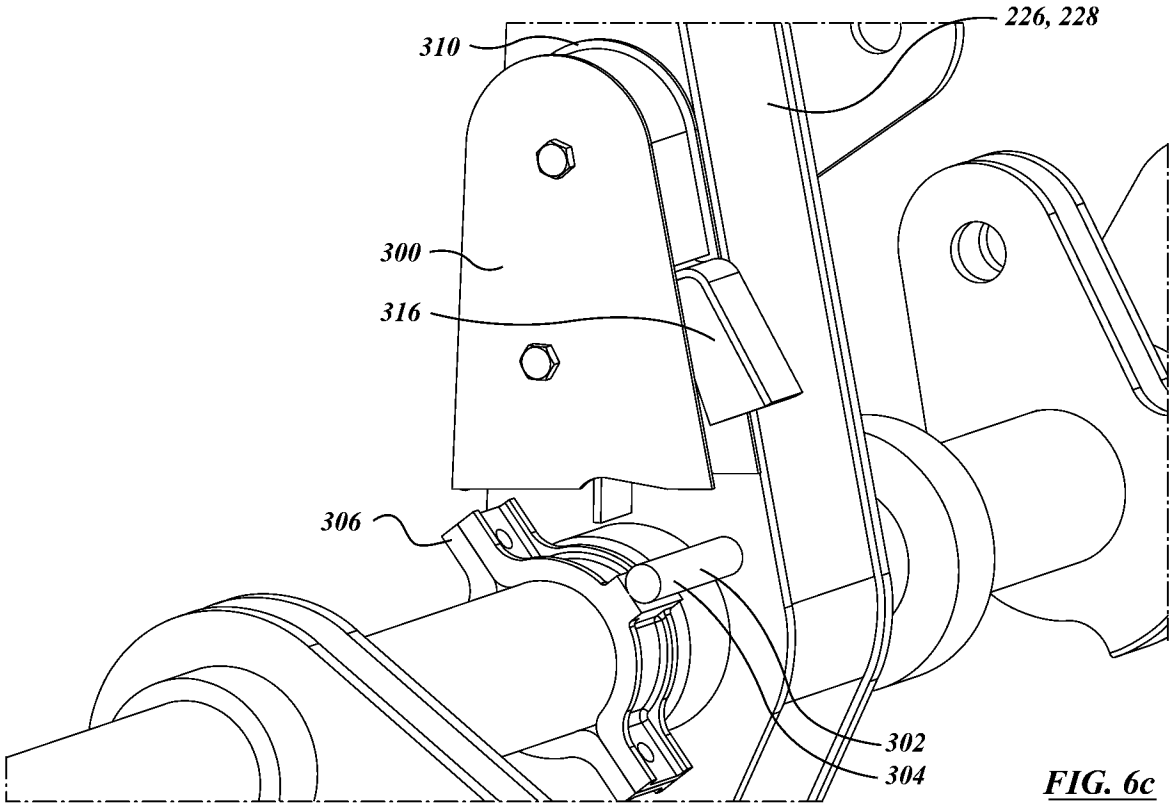
FIG. 6*c* is an enlarged detail of the position verification assembly of FIG. 6*b* in the doors not locked position
Figure 6D:
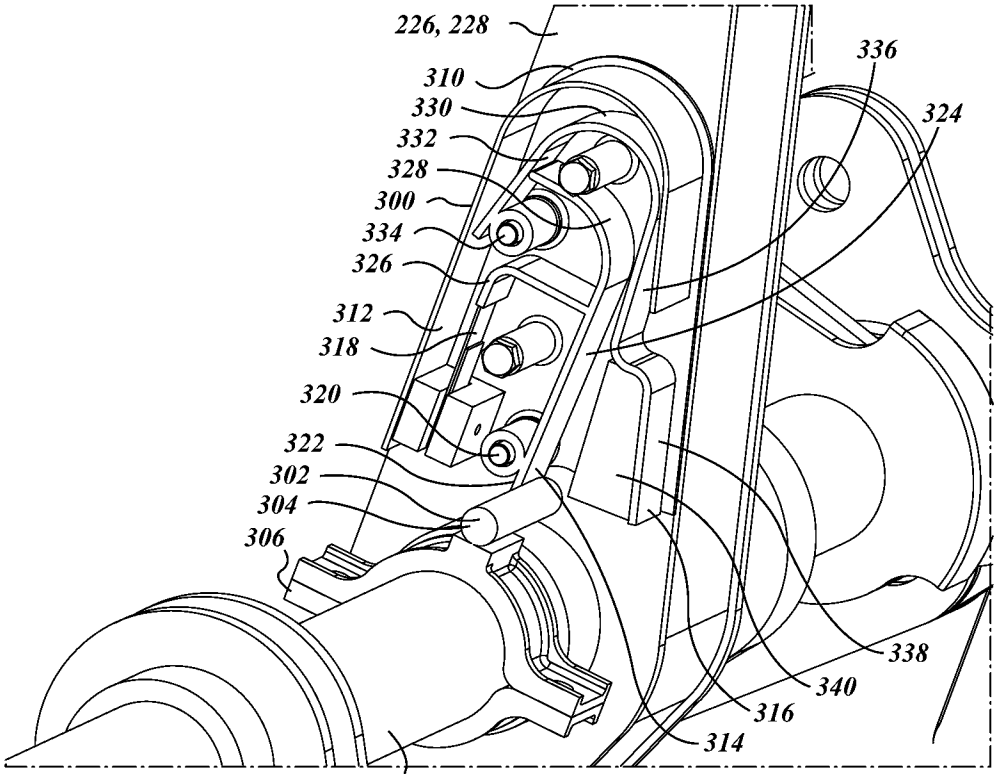
FIG. 6*d* shows the door position verification assembly of FIG. 6*b* in the same position with the cover removed to reveal the position of interior parts.
Figure 6E:
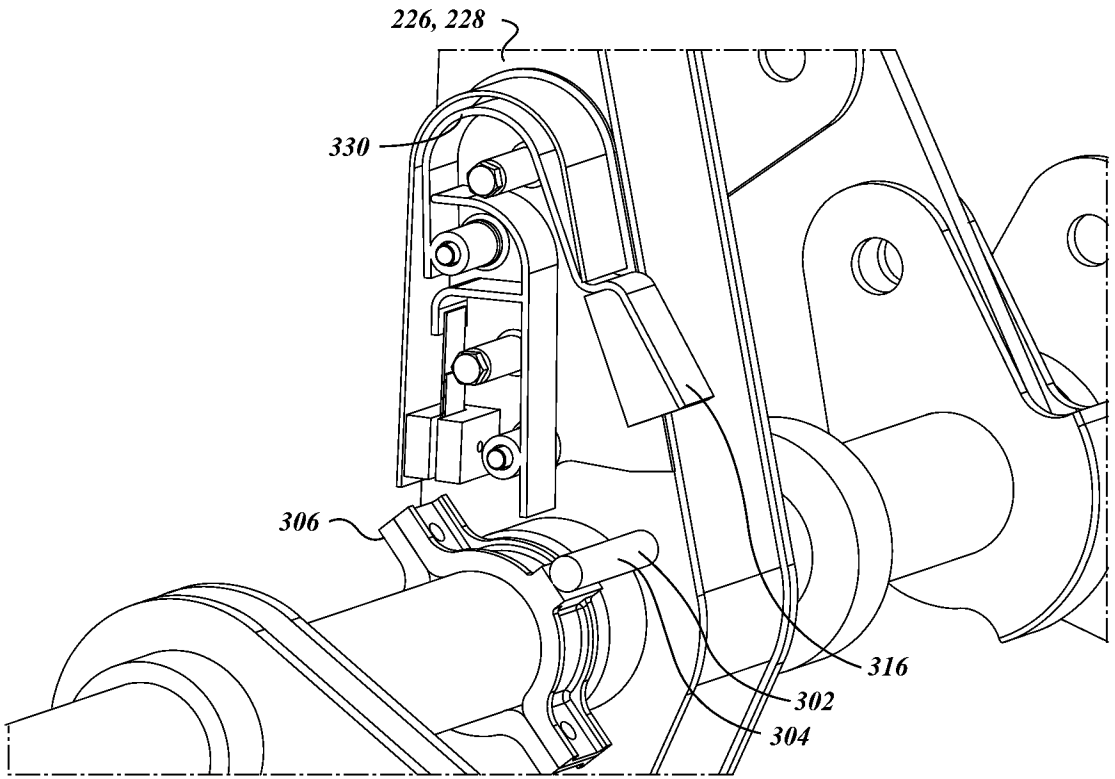
FIG. 6*e* shows the door position verification assembly of FIG. 6*c* in the same position with the cover removed to reveal the position of interior parts.

Referring to FIG. 6*a*, the normal, automatic or pneumatically driven door opening drive train is indicated notionally as 348. It includes the various linkage members that usually provide torque to torque tube 224. Manual drive system 350 includes a stationary datum member or assembly, or mount 352 having a first trunnion block 354 mounted between two legs. Drive system 350 also includes a moving member in the form of a pivotally mounted lever or arm 356, having a bifurcated distal end in which a second trunnion block 358 is mounted. The proximal end of lever arm 356 is mounted to pivot about the axis of torque tube 224. That proximal end is not, however, rigidly fixed to the proximal end. A drive member, which may be a threaded drive member such as acme screw 360 is mounted to pass through blocks 354 and 358. Either or both ends of screw 360 may be threaded. In the embodiment shown, the inboard end is threaded to mate with threaded block 358, and the outboard end has a smooth shank passing through a sleeve bushing in block 354. It will be understood that clockwise driving of the squared head 346 on the outboard end of screw 360 will tend to draw block 358 (and hence the yoke of lever arm 356) in the outboard direction. Rotation counter-clockwise will obviously do the reverse. Acme screw 360 is drivable by a person standing at trackside. It may be driven with a suitable wrench or Johnson bar, or, alternatively, it may be driven using a socket mounted on a pneumatic driver or other air-operated or gas-operated, or electrically operated tool.

Referring to FIGS. 7*a*-7*f*, it can be seen that there are first and second drive transmission fittings 362, 364 mounted at the end of torque tube 224. First drive transmission fitting 362 is a double input torque arm that is rigidly mounted to torque shaft 224. The driving pivot arm 214 is mounted to pivot about the axis of torque tube 224. It is not rigidly mounted, but rather loosely mounted. It is mounted between the axially spaced twin arms 366, 368 of first drive transmission fitting 362. Those two arms and pivot arm 214 have respective radially distant bores formed therethrough to accept a transmission interlink member, which, in the embodiment shown has the form of a shear pin 370. When pin 370 is in place, fitting 362 and pivot arm 258 are locked together, and so therefore pivot through the same angular displacement. When pin 370 is removed, arm 258 is free to rotate relative to torque tube 224, and thus no moment is transmitted from one to the other.

Figure 7A:
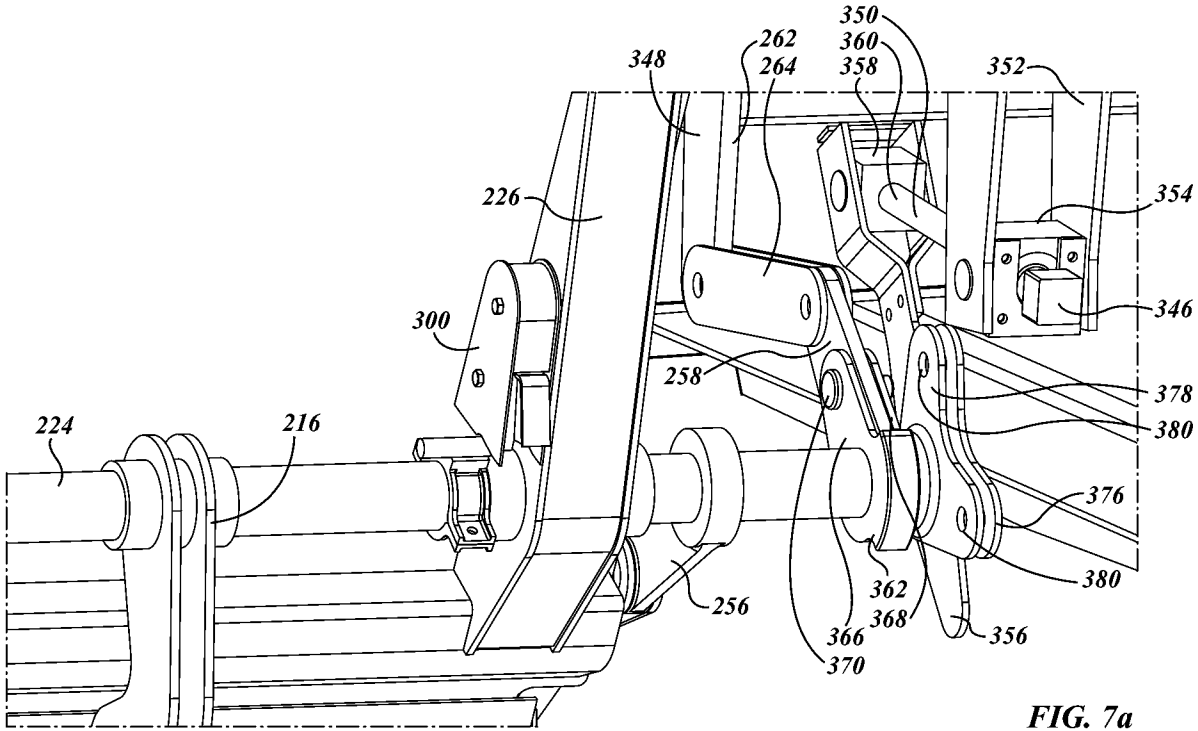
FIG. 7*a* shows the manual release mechanism of FIG. 6*a* in an inoperative position.
Figure 7B:
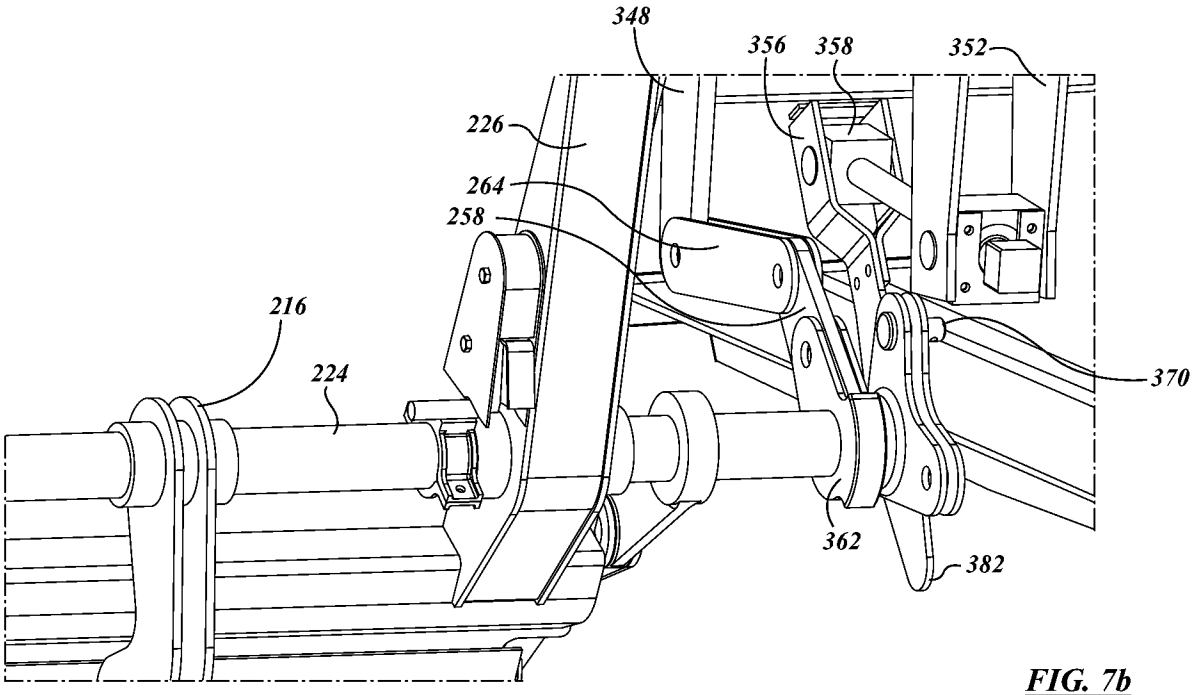
FIG. 7*b* shows the manual release mechanism of FIG. 7*a* in a release mode engaged condition, ready to trip the associated door open.
Figure 7C:
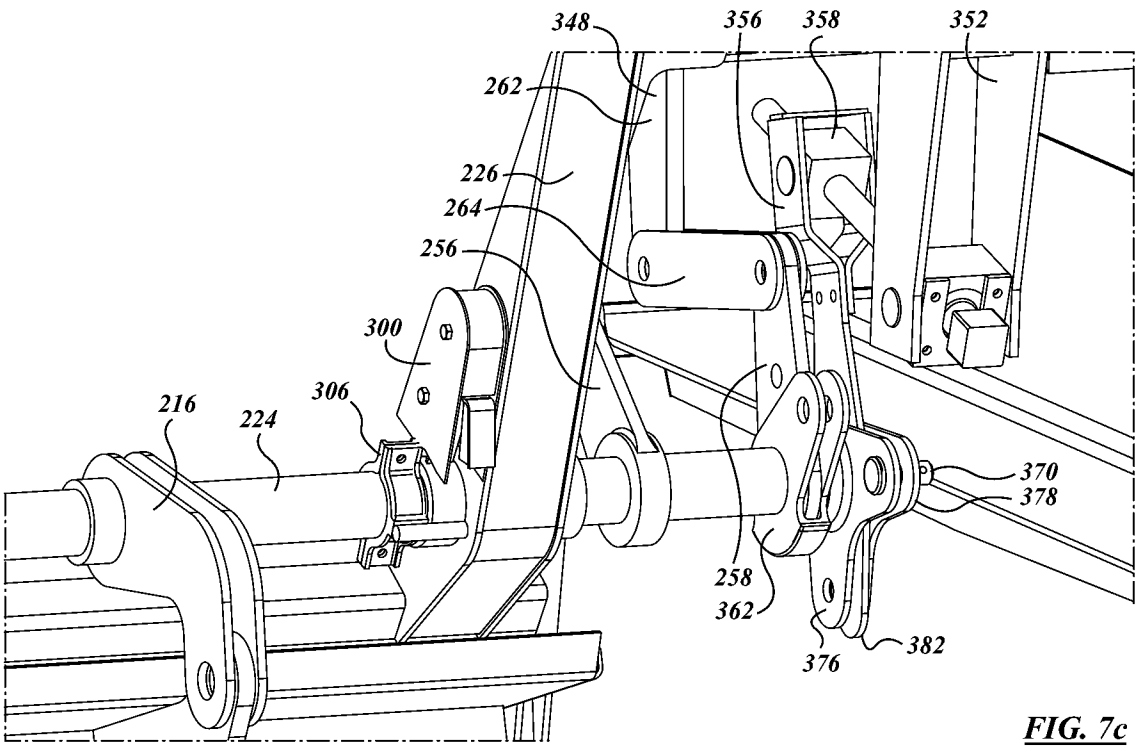
FIG. 7*c* shows the manual release mechanism of FIG. 7*b* in a position after the associated door has been tripped open.

Second transmission fitting 364 is likewise in the form of two parallel plates 372, 374, mounted rigidly to torque tube 224, such that they pivot with torque tube 224. Lever arm 356 is mounted to pivot in the plane between plates 372 and 374. Plates 372, 374 have a form similar to a bell crank—i.e., they have first and second lobes 376, 378, or arms, each of those arms having a radially offset penetration 380, such that pin 370 may be mounted across the respective openings. When pin 370 is in place, it will obstruct pivotal motion of lever arm 356, as shown in FIGS. 7*b*-7*f*. For example, in FIG. 7*b* the doors are closed. Pin 370 is in place, and lever arm 356 is in a position ready to be pivoted outboard, thus engaging pin 370 and tripping the door open. In FIG. 7*c*, the door has been tripped open. When it gets past the tripping point, i.e., it passes through the over center condition of the door drive linkages, gravity will swing the door further open, as indicated in FIG. 7*c*. Acme screw 360 can be driven further, to move the door toward the fully open position indicated in FIG. 7*d*.

Figure 7D:
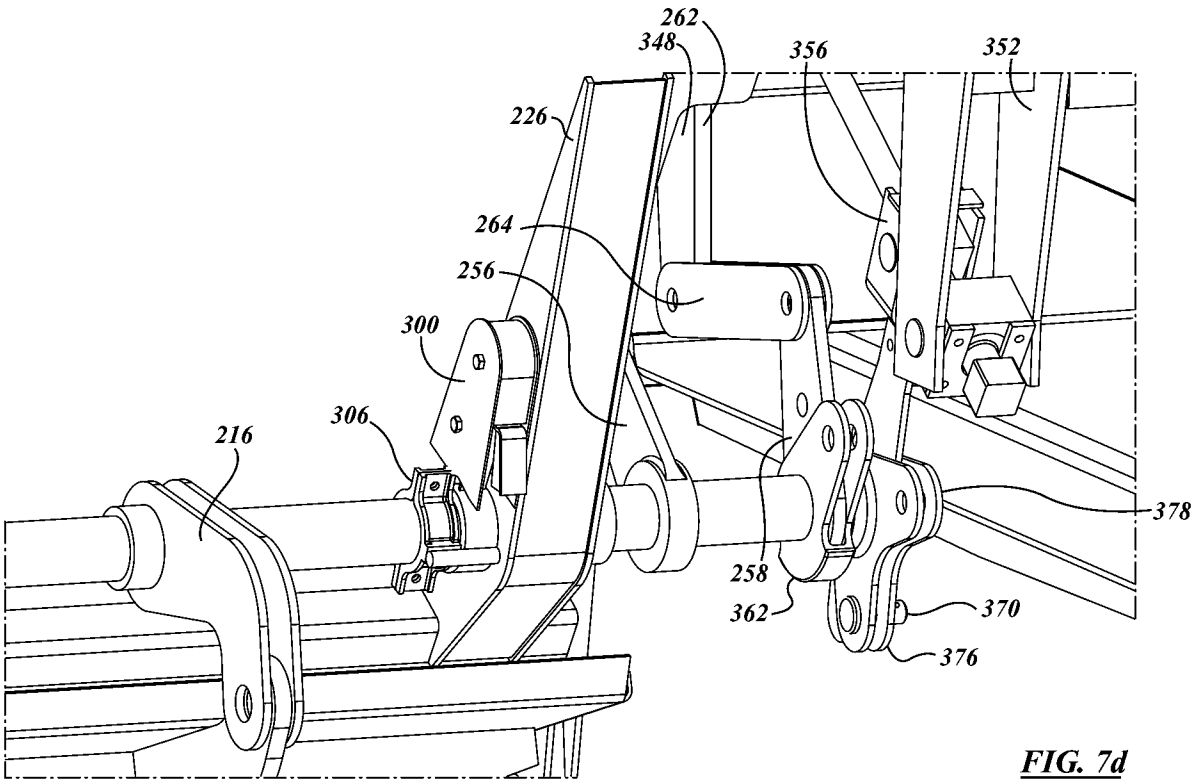
FIG. 7*d* shows the manual release mechanism of FIG. 7*a* in a closing mode engaged position ready to commence closing of the associated door.
Figure 7E:
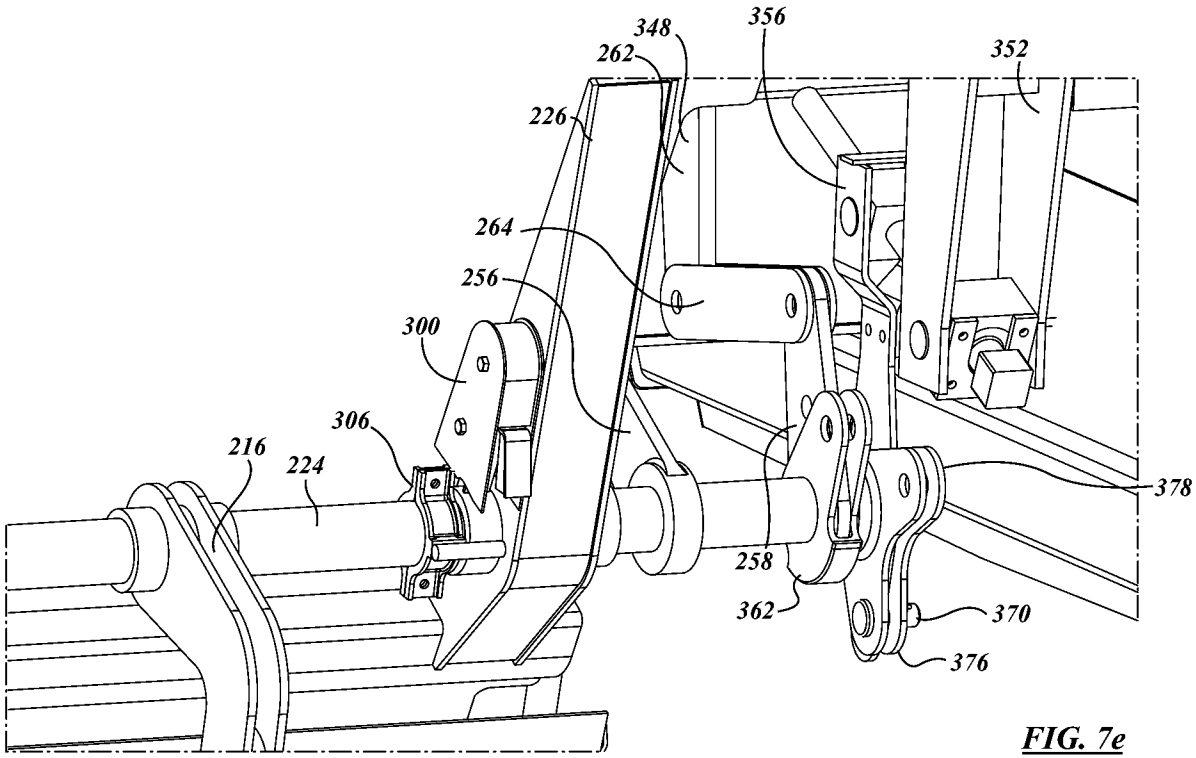
FIG. 7*e* shows the manual release mechanism of FIG. 7*d* in a partially closed position.
Figure 7F:
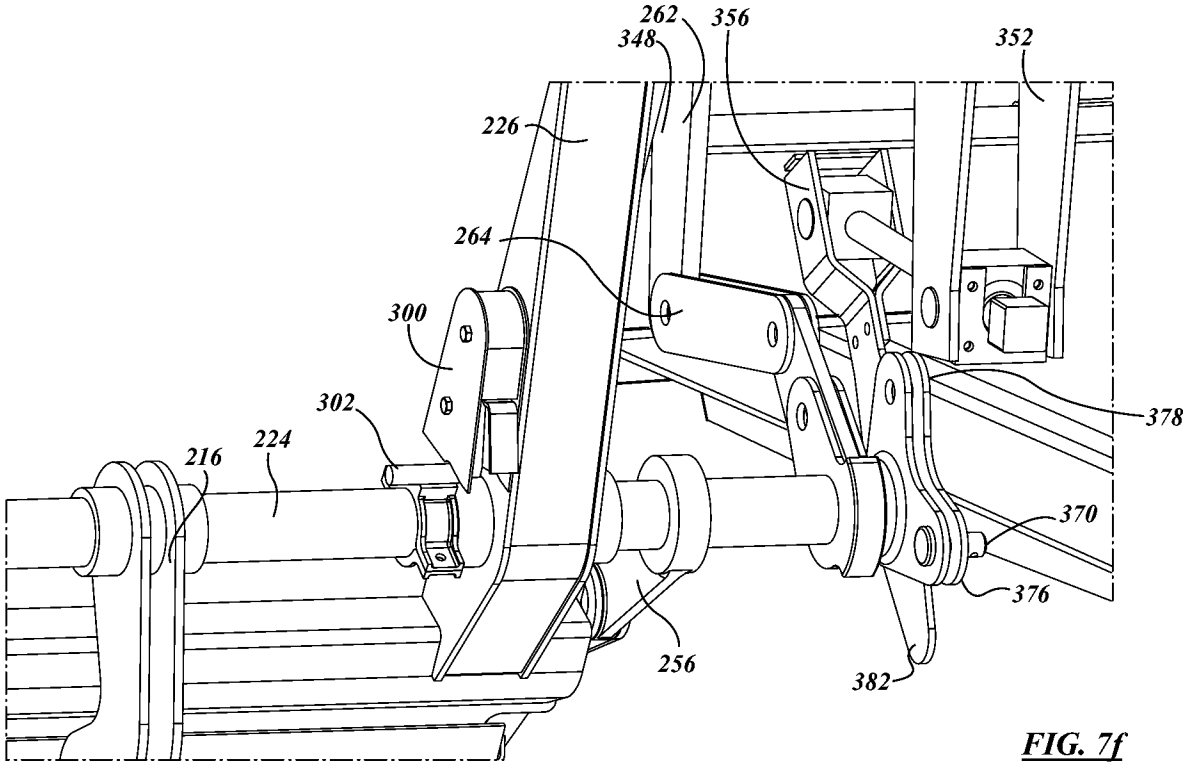
FIG. 7*f* shows the manual release mechanism of FIG. 7*d* in a fully closed condition.

Alternatively, when the door is in the open position as indicated in FIG. 7*d*, it may be desirable to close it manually. To that end, pin 370 is removed from first lobes 376, and placed in apertures 380 of second lobes 378 of plates 372 and 374. Reversing the rotation of screw 360 will drive lever arm 356 in the opposite direction, such that protruding end 382 of lever arm 356, which extends to the far side of the axis of rotation of torque tube 224, will be intercepted by pin 370. Driving pin 370 then forces torque shaft 224 to turn, causing the door drive linkages to move to close the door as shown in the progression of FIGS. 7*e* and 7*f*. Once the door is closed and locked, pin 370 may be returned to position in first fitting 362, reconnecting the automatic drive system and disconnecting the manual drive.

Various embodiments have been described in detail. Since changes in and or additions to the above-described examples may be made without departing from the nature, spirit or scope of the invention, the invention is not to be limited to those details.

We claim:

1. A railroad car having a body for carrying lading in the form of particulate matter, said car body being carried upon railroad car trucks for motion along railroad tracks in a longitudinal direction, said body having at least one discharge through which the lading may be disgorged under the influence of gravity, said discharge being governed by a door mechanism, said door mechanism including a door panel movable from a first position to a second position, said first position defining a closed position of said discharge in which said door panel obstructs exit of the lading, said second position defining an open position of said discharge;

said door panel is movably connected to said car body by at least a first linkage member and a second linkage member, said car body, said linkage members and said door panel defining a four bar linkage;

said first linkage member is mounted to said car body further laterally outboard than is said second linkage member;

one of:

(a) said second linkage is mounted to said railroad car body at first pivot fulcrum, and depends therefrom to a pivot connection with said door panel downwardly thereof;

(b) said first linkage member passes through a first angular displacement between said closed position and said open position; said second linkage member passes through a second angular displacement between said closed position and said open position; and said first angular displacement is larger than said second angular displacement;

(c) said second linkage member passes through a second angular displacement between said closed position and said open position; and during displacement of said second linkage member said second linkage member passes through a position in which said second linkage member is vertically oriented; and said door panel extending length-wise relative to said car body, and said door mechanism is a longitudinal door operating mechanism operable to move said door panel in a cross-wise direction relative to said railroad car body.

2. The railroad car of claim 1 wherein said car includes a cross-wise acting drive mechanism connected to move said door panel between said open position and said closed position.

3. The railroad car of claim 2 wherein said railroad car has a longitudinal centerline and said drive mechanism includes members acting transversely on either side of said longitudinal centerline.

4. The railroad car of claim 3 wherein said drive mechanism includes at least one driving linkage operable to move left and right hand doors simultaneously in opposite directions between said open position and said closed position.

5. The railroad car of claim 1 wherein said first linkage member is shorter than said second linkage member.

6. The railroad car of claim 1 wherein said railroad car has a coupler mounted to at least one end of said railroad car; said coupler has a coupler centerline height; said second linkage member has a first pivot connection at which said first linkage has a first end pivotally mounted to said railroad car body at a height greater than said coupler centerline height.

7. The railroad car of claim 1 wherein said first pivot fulcrum is located a first distance above Top of Rail; said first door panel has a width and a length, said length being oriented cross-wise relative to the car body generally, and said length being greater than said first distance.

8. The railroad car of claim 1 wherein said second linkage is mounted to said railroad car body at first pivot fulcrum, and depends therefrom to a pivot connection with said door panel downwardly thereof.

9. The railroad car of claim 1 wherein said first linkage member passes through a first angular displacement between said closed position and said open position;

said second linkage member passes through a second angular displacement between said closed position and said open position; and said first angular displacement is larger than said second angular displacement.

10. The railroad car of claim 1 wherein said second linkage member passes through a second angular displacement between said closed position and said open position; and during displacement of said second linkage member said second linkage member passes through a position in which said second linkage member is vertically oriented.

11. A railroad car having a body for carrying lading in the form of particulate matter, said car body being carried upon railroad car trucks for motion along railroad tracks in a longitudinal direction, said body having at least one discharge through which the lading may be disgorged under the influence of gravity, said discharge being governed by a door mechanism, said door mechanism including a door panel movable from a first position to a second position, said first position defining a closed position of said discharge in which said door panel obstructs exit of the lading, said second position defining an open position of said discharge;

said door panel being movably connected to said car body by at least a first linkage member and a second linkage member, said car body, said linkage members and said door panel defining a four bar linkage; and said door panel extending length-wise relative to said car body;

said door mechanism being a longitudinal door operating mechanism operable to move said door panel in a cross-wise direction relative to said railroad car body;

said door panel has a proximal portion and a distal portion, said linkage members include first and second linkages, and any one of:

(a) said first linkage is connected to said door panel at a connection closer to said proximal portion than to said distal portion, said second linkage is connected to said door panel closer to said distal portion than is said first linkage, and said proximal portion of said door panel has an overall dz/dy when said door panel moves between said first and second positions that is greater than one;

(b) said first linkage is connected to said door panel at a connection closer to said proximal portion than to said distal portion, said second linkage is connected to said door panel closer to said distal portion than is said first linkage, and said distal portion of said door panel has an overall dz/dy when said door panel moves between said first position and said second position that is less than one;

(c) said first linkage is connected to said door panel at a connection closer to said proximal portion than to said distal portion, said second linkage is connected to said door panel closer to said distal portion than is said first linkage, and said proximal portion of said door panel has an overall $(dz/dy)_1$ when said door panel moves between said first and second positions that is greater than one and said distal portion of said door panel has an overall $(dz/dy)_2$ when said door panel moves between said first position and said second position; and $(dz/dy)_1$ is greater than $(dz/dy)_2$.

12. A railroad hopper car having at a lading containment car body mounted upon railroad car trucks for rolling motion in a longitudinal direction along railroad car tracks, said hopper car body being compliant with AAR Plate C, said hopper car body comprising:

a pair of first and second hopper discharges and respective first and second longitudinal doors operable to move transversely to facilitate egress of lading from said hopper discharges;

said hopper discharges having a discharge flow dividing member located therebetween, said discharge flow dividing member having first and second flanks extending downwardly therefrom toward said first and second discharges respectively, a sheltered accommodation being defined between said flanks;

each of said doors being movable from (a) a first position obstructing egress of lading from one of said respective hopper discharges to (b) a second position less obstructive of discharge of lading from said respective hopper discharges;

each of said longitudinal doors having a proximal region and a distal region;

in said first position said proximal region being located more transversely outboard than is said distal region;

each of said proximal regions being connected by first and second linkage members to said car body; said first and second linkages having pivoting connections at either end thereof; and in operation, said proximal regions of said first and second doors moving upwardly and transversely outboard, said motion being more predominantly upwardly than outboard, said linkages not protruding widthwise beyond AAR Plate C more than 3 inches during motion thereof;

during motion of said linkages said distal regions of said doors moving more predominantly transversely outboard than upward; and a drive train operable to move said doors is mounted in said sheltered accommodation.

13. The railroad hopper car of claim 12 having a body for carrying lading in the form of particulate matter, wherein said first and second linkage members are short linkage members; there are also first and second long linkage members mounted to said distal region; and said car body, said short linkage members, said long linkage members and said door panel defining a four bar linkage.

14. The railroad hopper car of claim 12 wherein said drive train includes an actuator mounted in said accommodation, said actuator being mounted to work transversely.

15. A railroad hopper car having a car body mounted on railroad car trucks for rolling motion in a longitudinal direction along railroad tracks, said car body having a hopper discharge, egress of lading through the hopper discharge being governed by a door assembly, said door assembly being movable between a closed position for obstructing discharge of lading from the hopper, and at least one open position for permitting discharge of lading from the hopper, said door assembly being an hingeless door assembly, said door assembly including a door panel, said door panel being mounted to move transversely to said longitudinal direction on a non-circular path during motion between said closed position and said at least one open position;

said discharge having a length in the transverse direction when vertically projected; and said discharge having a peripheral edge for engagement by said door assembly, said peripheral edge having a clearance distance from Top of Rail when said car is on level tangent track, and said length in the transverse direction is greater than three times said clearance distance.

16. The railroad hopper car of claim 15 wherein said door panel has a translational component of motion and a rotational component of motion in moving between said closed position and said at least one open position.

17. The railroad hopper car of claim 15 wherein in said closed position of said door assembly said door panel is in a predominantly horizontal orientation, and in said at least one open position said door assembly is in a less predominantly horizontal orientation.

18. The railroad hopper car of claim 17 wherein said door assembly has a fully open position, and in said fully open position said door panel is predominantly vertically oriented.

19. The railroad hopper car of claim 15 wherein said railroad car has a first hopper, a second hopper, and an accommodation defined therebetween whence lading is excluded, each of said hoppers has one of said door assemblies, each door panel of each said door assembly is movable to a most fully open position, and said car has at least one actuator mounted to drive said door assemblies, and said at least one actuator is also sheltered from lading by said accommodation.

20. A railroad car having a body for carrying lading in the form of particulate matter, said car body being carried upon railroad car trucks for motion along railroad tracks in a longitudinal direction, the railroad car having a coupler mounted to at least one end thereof, the coupler having a coupler centerline height, wherein:

at least one discharge through which the lading may be disgorged under the influence of gravity, said discharge being governed by a door mechanism;

said door mechanism including a door panel movable from a first position to a second position, said first position defining a closed position of said discharge in which said door panel obstructs exit of the lading, said second position defining an open position of said discharge;

said door panel being movably connected to said car body by at least a first linkage member and a second linkage member, said car body, said linkage members and said door panel defining a four bar linkage;

said second linkage member has a first pivot connection at which said first linkage has a first end pivotally mounted to said railroad car body at a height greater than said coupler centerline height; and said door panel extending length-wise relative to said car body, and said door mechanism is a longitudinal door operating mechanism operable to move said door panel in a cross-wise direction relative to said railroad car body.

21. The railroad car of claim 20 wherein said car includes a cross-wise acting drive mechanism connected to move said door panel between said open position and said closed position.

22. The railroad car of claim 21 wherein said railroad car has a longitudinal centerline and said drive mechanism includes members acting transversely on either side of said longitudinal centerline.

23. The railroad car of claim 22 wherein said drive mechanism includes at least one driving linkage operable to move left and right hand doors simultaneously in opposite directions between said open position and said closed position.

24. The railroad car of claim 20 wherein said first linkage member is shorter than said second linkage member, and said first linkage member is mounted to said car body further laterally outboard than is said second linkage member.

25. The railroad car of claim 24 wherein one of:

(a) said second linkage is mounted to said railroad car body at first pivot fulcrum, and depends therefrom to a pivot connection with said door panel downwardly thereof;

(b) during motion of said door panel between said closed position and said open position said first linkage member travels through a greater angular arc than does said second linkage member; and (c) during motion of said door panel between said closed position and said open position, said second linkage passes through a vertical position.

26. A railroad hopper car having a car body mounted on railroad car trucks for rolling motion in a longitudinal direction along railroad tracks, said car body having a straight-through center sill extending from end-to-end thereof, said car body having a hopper discharge, egress of lading through the hopper discharge being governed by a door assembly, said door assembly being movable between a closed position for obstructing discharge of lading from the hopper, and at least one open position for permitting discharge of lading from the hopper, said door assembly being an hingeless door assembly, said door assembly including a door panel, said door panel being mounted to move transversely to said longitudinal direction on a non-circular path during motion between said closed position and said at least one open position.

27. The railroad hopper car of claim 26 wherein said door panel has a translational component of motion and a rotational component of motion in moving between said closed position and said at least one open position.

28. The railroad hopper car of claim 26 wherein said discharge has a length in the transverse direction when vertically projected, said discharge has a peripheral edge for engagement by said door assembly, said peripheral edge has a clearance distance from Top of Rail when said car is on level tangent track, and said length is greater than three times said clearance distance.

29. The railroad hopper car of claim 28 wherein in said closed position of said door assembly said door panel is in a predominantly horizontal orientation, and in said at least one open position said door assembly is in a less predominantly horizontal orientation.

30. The railroad hopper car of claim 28 wherein said door assembly has a fully open position, and in said fully open position said door panel is predominantly vertically oriented.

31. The railroad hopper car of claim 26 wherein said railroad car has a first hopper, a second hopper, and an accommodation defined therebetween whence lading is excluded, each of said hoppers has one of said door assemblies, each door panel of each said door assembly is movable to a most fully open position, and said car has at least one actuator mounted to drive said door assemblies, and said at least one actuator is also sheltered from lading by said accommodation.

* * * * *